US007661179B2

(12) United States Patent
Parker et al.

(10) Patent No.: US 7,661,179 B2
(45) Date of Patent: Feb. 16, 2010

(54) MEMORIALIZATION CASKET

(75) Inventors: Daniel J. Parker, Connersville, IN (US); Gregory W. Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 246 days.

(21) Appl. No.: 11/350,986

(22) Filed: Feb. 9, 2006

(65) Prior Publication Data

US 2006/0207076 A1 Sep. 21, 2006

Related U.S. Application Data

(63) Continuation-in-part of application No. 11/096,599, filed on Apr. 1, 2005, now Pat. No. 7,392,574, which is a continuation-in-part of application No. 10/687,132, filed on Oct. 16, 2003, now Pat. No. 7,316,053.

(51) Int. Cl.
*A61G 17/00* (2006.01)

(52) U.S. Cl. ..... 27/2

(58) Field of Classification Search ..... 27/19, 27/14, 2, 1; D99/1, 2, 8, 9; 220/480, 482; 206/557; 190/35; 312/126; 108/50.11, 160
See application file for complete search history.

(56) References Cited

U.S. PATENT DOCUMENTS 443,209 A 12/1890 Ripsom
458,527 A 8/1891 Freshl
494,297 A 3/1893 Leonhardt
504,009 A 8/1893 Whitney
545,176 A 8/1895 Ruebekam
1,486,773 A * 3/1924 McClain ..... 211/106
1,888,127 A * 11/1932 Hearne ..... 248/207
2,159,144 A 5/1939 Fletcher ..... 27/12
2,526,793 A 10/1950 Alfred ..... 311/103
2,604,369 A 7/1952 Phillips et al. ..... 311/16.5
3,325,038 A * 6/1967 Ferney ..... 52/11
4,177,543 A 12/1979 Angermann ..... 27/35
4,457,054 A 7/1984 Craft et al. ..... 27/1
4,788,757 A 12/1988 Bethune et al. ..... 27/2
5,481,785 A 1/1996 Minton et al. ..... 27/27
5,562,049 A 10/1996 Hoffman et al. ..... 108/94
5,611,124 A 3/1997 Biondo et al. ..... 27/2
5,624,095 A * 4/1997 Zissu ..... 248/231.81
5,675,876 A 10/1997 Benedict et al. ..... 27/2
5,678,289 A 10/1997 Saaf ..... 27/2
5,727,291 A 3/1998 Biondo et al. ..... 27/2
5,749,554 A 5/1998 Avila et al. ..... 248/311.2
5,771,814 A 6/1998 Clausen ..... 108/93
5,862,847 A * 1/1999 Jenkins ..... 144/346
5,956,825 A 9/1999 McCoy et al. ..... 27/2
6,237,799 B1 * 5/2001 Emerson ..... 220/480
6,322,123 B1 11/2001 Garrison et al. ..... 296/26.1
6,324,736 B1 12/2001 Atrio ..... 27/2
6,324,737 B1 12/2001 Chamness et al. ..... 27/2
7,249,402 B2 * 7/2007 Davis et al. ..... 27/18

* cited by examiner

*Primary Examiner*—William L. Miller
(74) *Attorney, Agent, or Firm*—Wood, Herron & Evans, LLP

(57) ABSTRACT

A casket comprises a casket shell having an upper edge, a casket lid closeable upon the shell, and a memorial shelf connected to the upper edge of the shell, the shelf adapted to support items of memorialization thereon.

48 Claims, 31 Drawing Sheets

MEMORIALIZATION CASKET

RELATED APPLICATIONS

This application is a continuation-in-part of U.S. patent application Ser. No. 11/096,599 filed Apr. 1, 2005, now U.S. Pat. No. 7,392,574, which is a continuation-in-part of U.S. patent application Ser. No. 10/687,132 filed Oct. 16, 2003, now U.S. Pat. No. 7,316,053, both of which are hereby incorporated by reference herein.

FIELD OF THE INVENTION

This invention relates generally to the death care industry, and more particularly to personalized caskets for memorializing a deceased.

BACKGROUND OF THE INVENTION

There is a trend in the death care industry to make efforts towards "personalizing" the funeral products and the funeral or other memorial service purchased for the deceased to provide a more meaningful memorial experience for the family and friends of the deceased. One of the earlier attempts at providing a means of personalizing or customizing a casket to the deceased may be seen with reference to the Assignee's U.S. Pat. No. 4,457,054 titled Casket Shelf, hereby incorporated by reference herein. That patent discloses a casket shelf which is mounted to the dish assembly of the head end cap when the head end cap is in the open position. The shelf provides a surface for supporting and displaying articles of religious or personal significance to the deceased when the head end cap is open during viewing of the deceased. The shelf is removed from the dish assembly when the head end cap is closed, i.e. the shelf is not integrally formed as a part of the casket.

More recently, caskets have been provided with memorabilia drawers in which keepsakes of the deceased can not only be displayed, but can be stored as well, as disclosed in the Assignee's U.S. Pat. Nos. 5,611,124 and 5,727,291, both titled Casket Having Memorabilia Compartment and hereby incorporated by reference herein. In these patents the items of memorabilia in the drawer can be displayed when the head end cap is open during viewing of the deceased by withdrawing the drawer from the foot end cap, and can be stored by inserting the drawer into the foot end cap. The caskets of these patents are commercially available from the assignee as the MemorySafe® line of caskets.

Caskets have also been provided with memorabilia trays that pivot into and out of the casket shell in which keepsakes of the deceased can be displayed when the tray is pivoted out of the casket shell and stored when the tray is pivoted into the casket shell, as disclosed in the Assignee's U.S. Pat. No. 5,675,876, entitled Casket With Pivoting Memorabilia Tray and hereby incorporated by reference herein.

Advances have therefore been made in the area of "personalization" of funeral products. However, there continues to be room for improvement in the area of personalization in the death care industry.

SUMMARY OF THE INVENTION

The present invention is a casket comprising a casket shell having an upper edge, a casket lid closeable upon the shell, and a memorial shelf connected to the upper edge of the shell, the shelf adapted to support items of memorialization thereon.

In another aspect, the present invention is a full couch casket comprising a casket shell having an upper edge and an interior therein, a single casket lid closeable upon the shell and covering an entirety of the interior of the shell, and a memorial shelf connected to the upper edge of the shell and projecting toward the interior of the shell, the shelf adapted to support items of memorialization thereon.

The shell can have a pair of sides and a pair of ends. The shelf can be mounted to one of the sides of the shell. The shelf can be semi-circular shaped. The shelf can be mounted to one of the sides of the shell and to an adjacent one of the ends of the shell. The shelf can be pie-shaped.

The upper edge of the flange can have an upturned lip thereon.

The shelf can have a bracket mounted thereon having a downturned lip thereon. The downturned lip on the shelf bracket can be supported on the upturned lip of the shell edge.

The shelf can include a brace mounted thereto. The brace can contact an interior wall of the shell and support said shelf. The brace can be attached to an underneath side of the shelf by at least one hinge, whereby the brace can be folded to and between a shelf supporting position generally perpendicular to the shelf and a storage position generally parallel and abutting the shelf.

The shelf can have a bracket mounted thereon having a downturned lip thereon, and a brace mounted thereto. The downturned lip on the shelf bracket can be supported on the upturned lip of said shell edge. The brace can contact an interior wall of the shell and support the shelf.

The shelf can include a pair of L-shaped rods mounted thereto. Each of the pair can have a leg and a foot. The leg can be mounted to the shelf. The foot can extend downward into the upper edge of the lid. The foot can extend downward through a hole in the upturned lip. The rods can be circular in cross-section and can be mounted to an underneath side of the shelf with semi-circular brackets, whereby the rods can be folded to and between a shelf supporting position generally perpendicular to the shelf and a storage position generally parallel and abutting the shelf.

The upper edge of the shell can be formed to include first and second surfaces and the shelf can have a pair of braces mounted thereon each having first and second surfaces which cooperate with the first and second surfaces of the upper edge of the shell to thereby provide moment load carrying capability for the brace and hence the shelf.

The shelf can have a brace and at least two upturned brackets mounted thereto. The brace can contact an interior wall of the shell and the brackets can receive therein the upturned lip of the upper edge of the shell to thereby support the shelf.

One edge of the shelf can have at least one L-shaped rod mounted thereto. The rod can have a leg and a foot. The leg can be mounted to the shelf. The foot can extend downward through a hole in the upper edge of the lid. The other edge of the shelf can have at least one upturned bracket mounted thereto. The bracket can receive therein the upturned lip of the upper edge of the shell to thereby support the shelf.

One edge of the shelf can have at least two L-shaped rods mounted thereto. The rods each can have a leg and a foot. The leg can be mounted to the shelf. The foot can extend downward through a hole in the upper edge of the lid. The one edge of the shelf can have a brace contacting an interior wall of the shell to thereby support the shelf.

The shelf can have a brace constructed of flat stock having a leg and a foot. The leg can be mounted to the shelf. The foot can extend downward through a slot in the upturned lip of the upper edge of the lid to thereby support the shelf.

One edge of the shelf can have at least one upturned bracket mounted thereto. The other edge of the shelf can have at least one upturned bracket mounted thereto. Each upturned bracket can have a downturned lip thereon. The brackets can receive therein the upturned lip of the upper edge of the shell. The downturned lips of the brackets can be supported on an edge of the upturned lip on the upper edge of the shell to thereby provide moment load carrying capability for the brackets and hence the shelf.

The shelf can have a brace and at least two upturned brackets mounted thereto. Each upturned bracket can have a downturned lip thereon. The brackets can receive therein the upturned lip of the upper edge of the shell. The downturned lips of the brackets can be supported on an edge of the upturned lip on the upper edge of the shell to thereby provide moment load carrying capability for the brackets and hence the shelf, the brace contacting an interior wall of the shell.

The shelf can have a L-shaped rod mounted thereto having a leg and a foot. The leg can be mounted to the shelf. The foot can extend downward through a hole in the upturned lip of the upper edge of the lid. The shelf can have at least two upturned brackets mounted thereto. The brackets can receive therein the upturned lip of the upper edge of the shell, the brace contacting an interior wall of the shell. The rod can be circular in cross-section and can be mounted to an underneath side of the shelf with semi-circular brackets, whereby the rod can be folded to and between a shelf supporting position generally perpendicular to the shelf and a storage position generally parallel and abutting the shelf.

In yet another aspect, a full couch casket comprises a casket shell having an upper edge and an interior therein, a single casket lid closeable upon the shell and covering an entirety of the interior of the shell, and a memorial shelf connected to the upper edge of the shell and projecting toward the interior of the shell, the shelf adapted to support items of memorialization thereon. The shelf is supported on an upper end of a screw of a lift mechanism. The shelf has a screw secured to an underside thereof. The screw carries a washer. The washer is positioned beneath a flange of the shell. The shelf is also supported on a clip secured to the flange of the shell.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
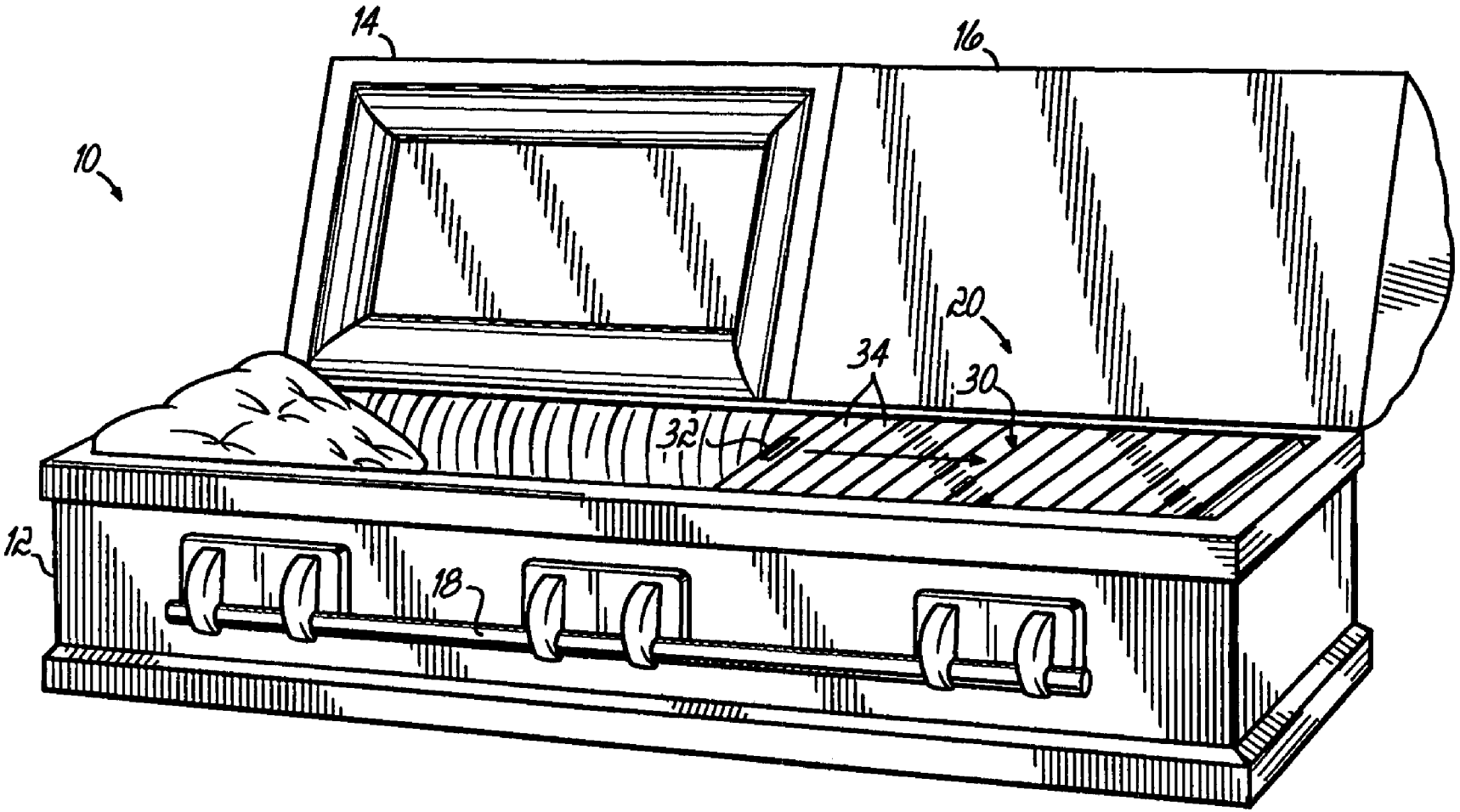
FIG. 1 is a perspective view of one embodiment of the present invention.
Figure 2A:
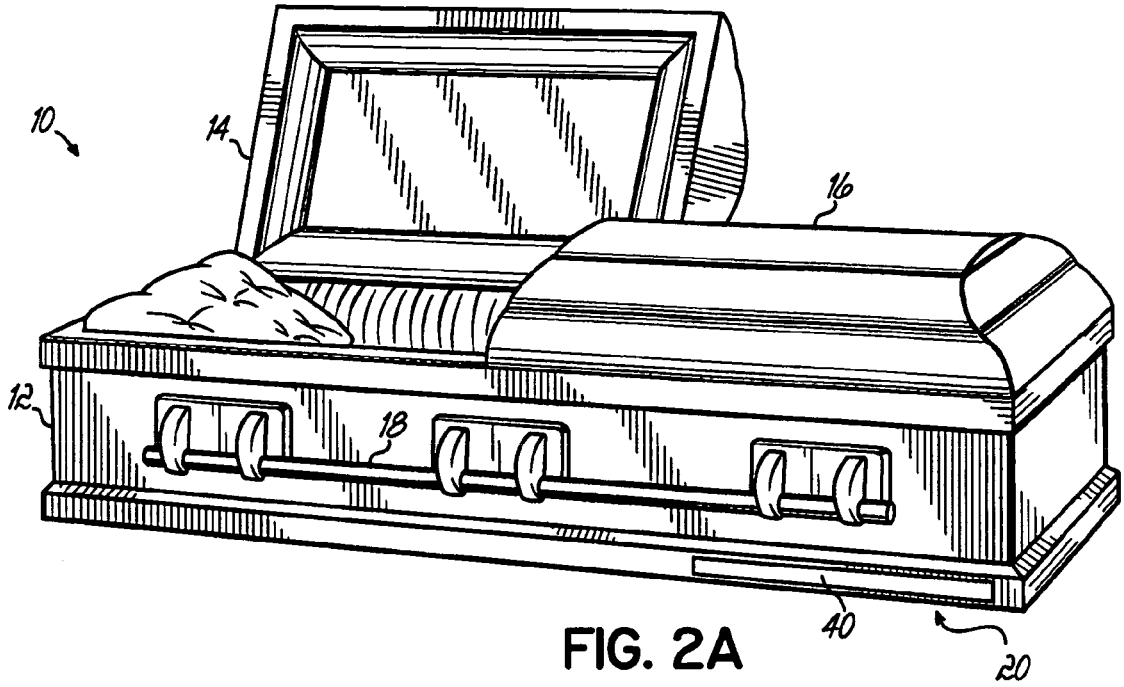
FIGS. 2A and 2B are perspective views of another embodiment.
Figure 2B:
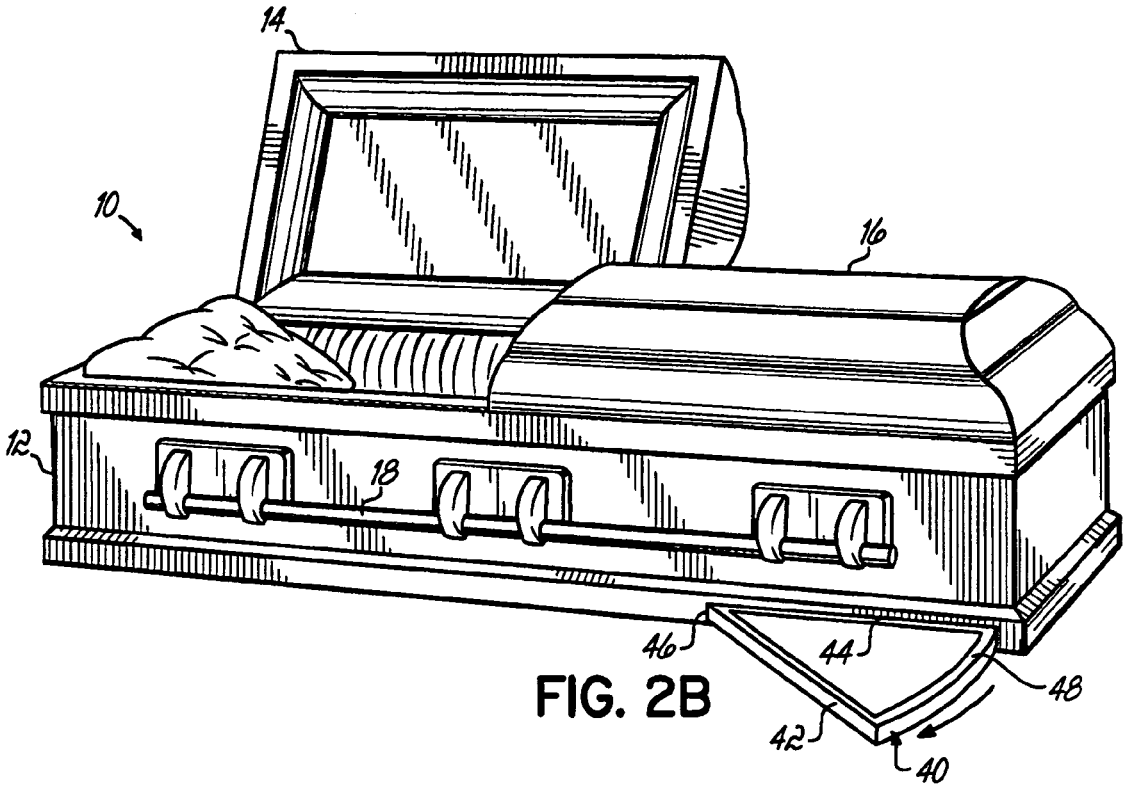
Figure 3A:
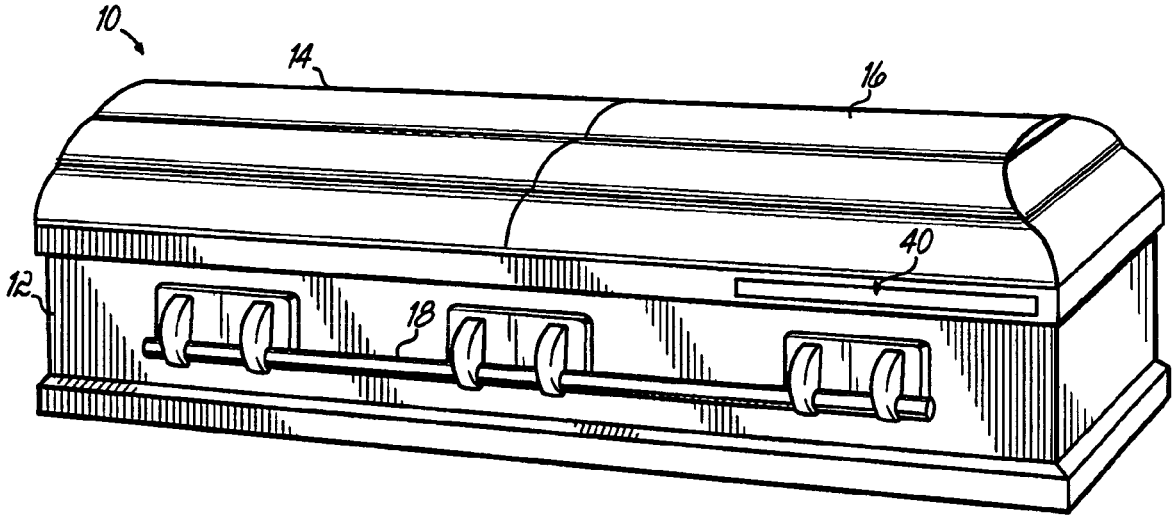
FIGS. 3A and 3B are perspective views of another embodiment.
Figure 3B:
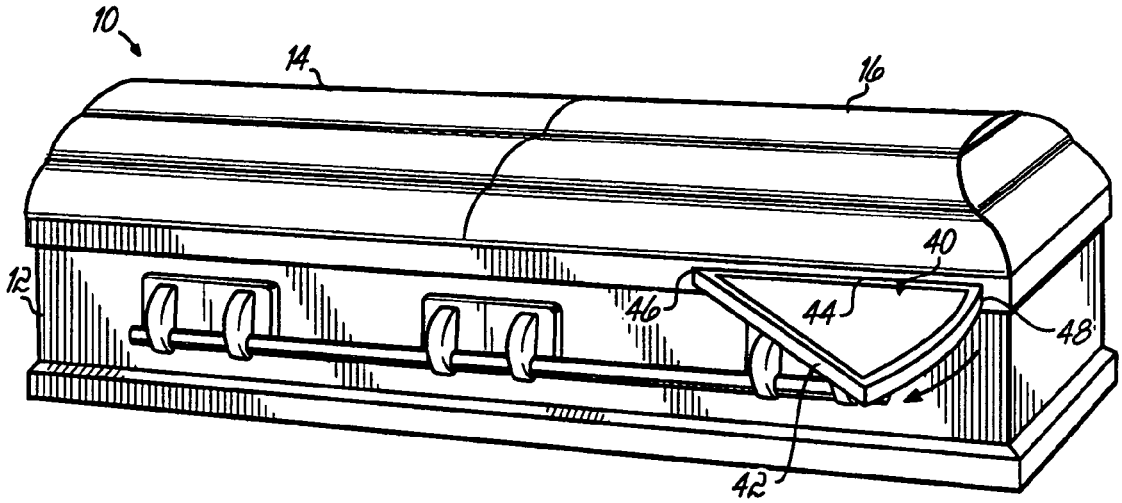

Referring first to FIG. 1, there is illustrated a casket 10 according to the present invention. Casket 10 includes a shell 12, a head end lid 14, a foot end lid 16 and handling structure 18. Casket 10 further includes deployable structure 20 which, when deployed, defines a memorial surface adapted to have placed thereon items of memorialization. Deployable structure 20 can either be operably associated with the shell 12 or the lid (14 and/or 16), and further is integrally formed therewith, i.e. is not a separate item but rather is constructed as a part of either the shell or lid as the case may be. As illustrated in FIG. 1, deployable structure 20 is operably associated with the shell 12, as are the other embodiments illustrated in FIGS. 2-8; the embodiments illustrated in FIGS. 9-17C have deployable structure 20 operably associated with the lid, either head end lid 14, foot end lid 16 or one-piece, full length lid 22 (FIG. 10). Furthermore, those embodiments illustrated and/or described as being associated with the head end lid 14 could just as well function in association with foot end lid 16 and vice versa, and those embodiments illustrated and/or described as being associated with either a head end lid 14 or foot end lid 16 could just as well function in association with a full length lid 22, unless otherwise indicated. Accordingly, the claims shall embrace all such variations.

Referring still to FIG. 1 (and to all the other Figs. for that matter), structure 20 is configured and arranged such that items of memorialization must be removed therefrom when the structure is not deployed. In other words, structure 20 is intended to define merely a two-dimensional surface atop which the items of memorialization can be displayed, rather than a three-dimensional volume in which the items can be stored as well as displayed. To that end, the structure 20 of FIG. 1 takes the form of a roll-type shelf 30 mounted in the shell 12 at a foot end thereof. To deploy the shelf 30, one grasps the head end 32 of the shelf 30 and pulls the shelf 30 from the foot end of the shell 12 toward the head end of the shell 12. To move the shelf 30 into its unemployed position, the shelf 30 is moved in the opposite direction toward the foot end of the shell 12. The individual slats 34 permit the roll-type shelf to roll downwardly along the inside surface of foot end wall of the shell 12 and then forwardly toward the head end wall of the shell 12, and vice versa.

Referring now to FIGS. 2A, 2B, 3A and 3B, structure 20 takes the form of a pie-shaped shelf 40 mounted in the shell 12. Shelf 40 has first and second edges 42, 44 having first interconnected ends forming an apex 46, and second ends interconnected by a third arcuate edge 48. The shelf 40 is pivoted to the shell 12 at the apex 46, and is deployed by grasping the leading edge (edge 42 as illustrated) and pulling the shelf outwardly. The shelf 40 can be mounted to the shell 12 at the lower edge thereof (FIGS. 2A and 2B), the upper edge thereof (FIGS. 3A and 3B), the end thereof (FIGS. 2A, 2B, 3A and 3B) and/or the side thereof (FIGS. 2A, 2B, 3A and 3B).

Figure 4A:
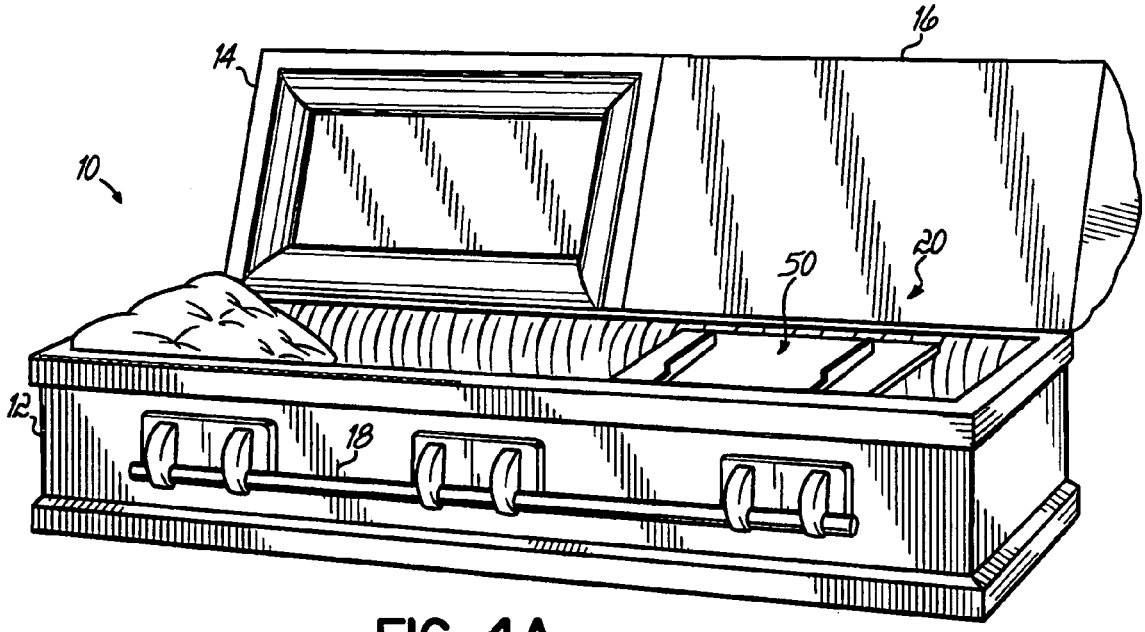
FIGS. 4A and 4B are perspective views of another embodiment.
Figure 4B:
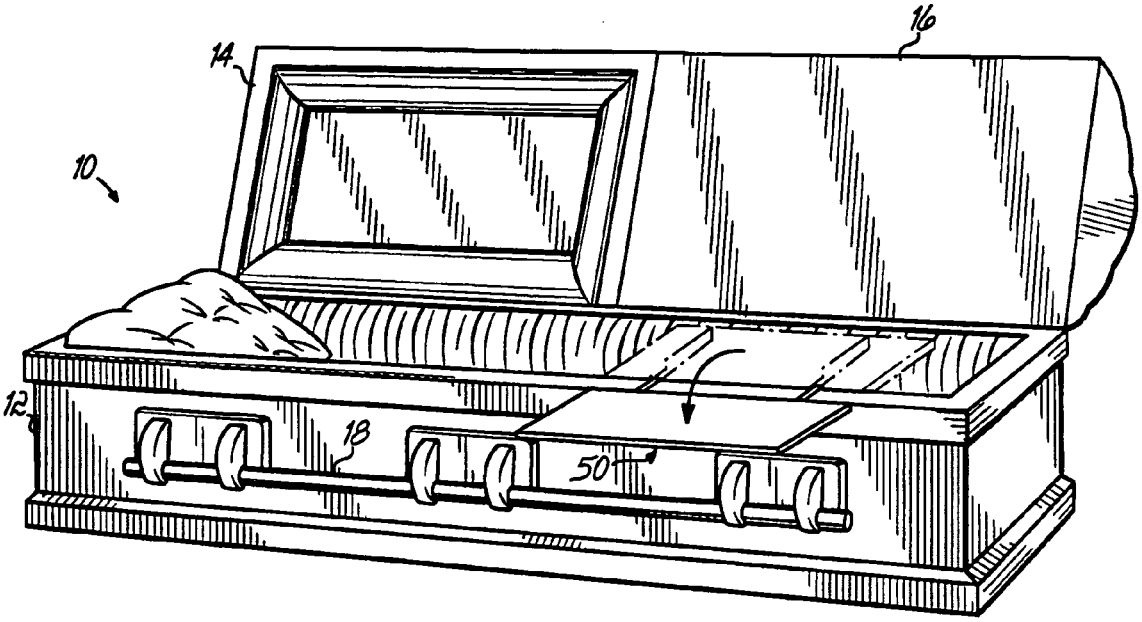

Referring now to FIGS. 4A and 4B, structure 20 takes the form of a shelf 50 pivotally mounted to the shell 12 at a forward side thereof and at an upper edge thereof. The shelf 50 is deployed by first opening (as illustrated) the foot end lid 16, pivoting the shelf 50 out of the shell 12 and then closing the lid 16.

Figure 5A:
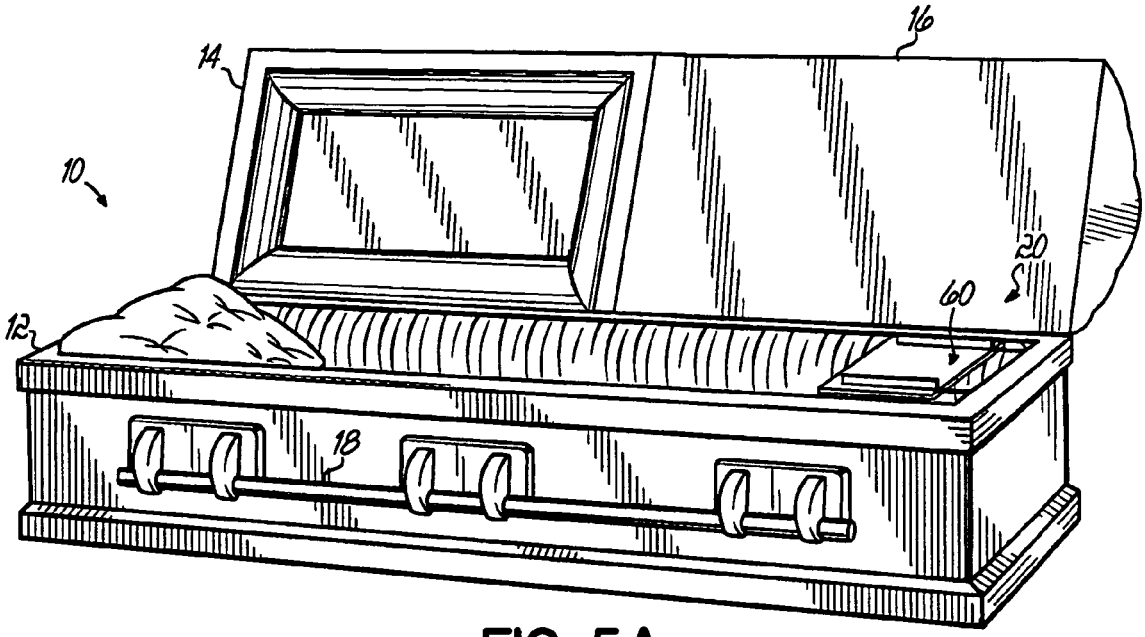
FIGS. 5A-5C are perspective views of another embodiment.
Figure 5B:
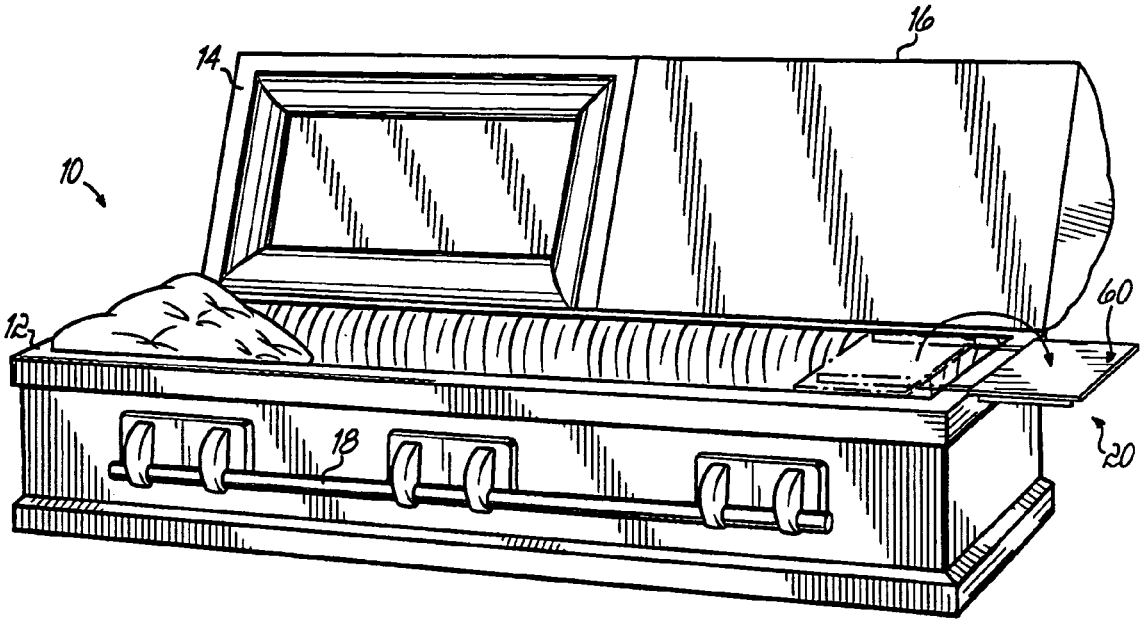
Figure 5C:
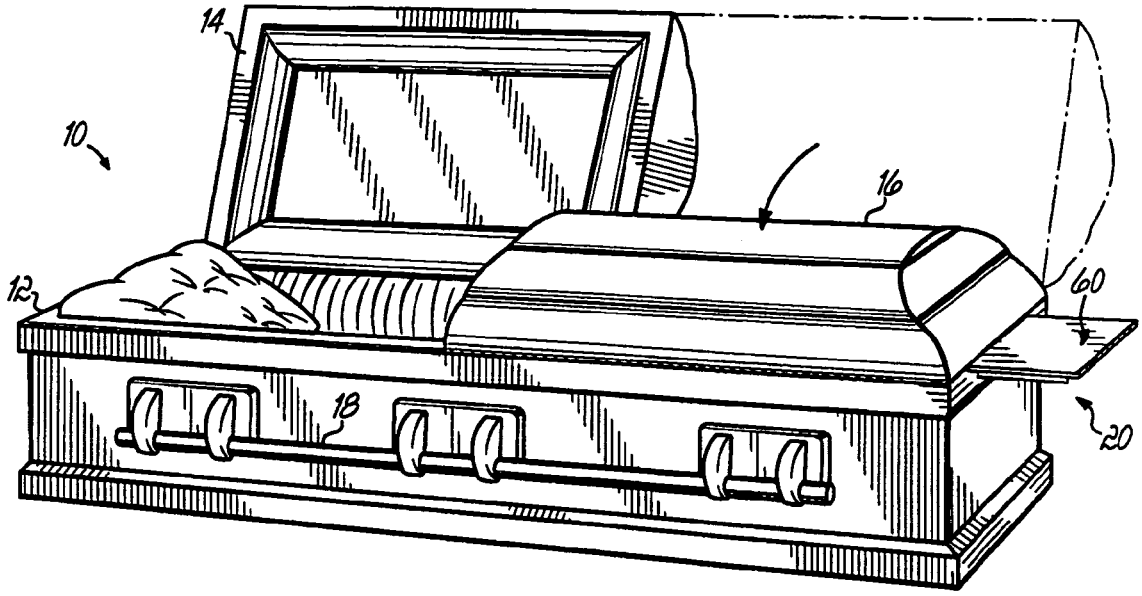

Referring now to FIGS. 5A-5C, structure 20 takes the form of a shelf 60 pivotally mounted to the shell 12 at a foot end thereof and at an upper edge thereof. The shelf 60 is deployed by first opening (as illustrated) the foot end lid 16, pivoting the shelf 60 out of the shell 12 and then closing the lid 16.

Figure 6A:
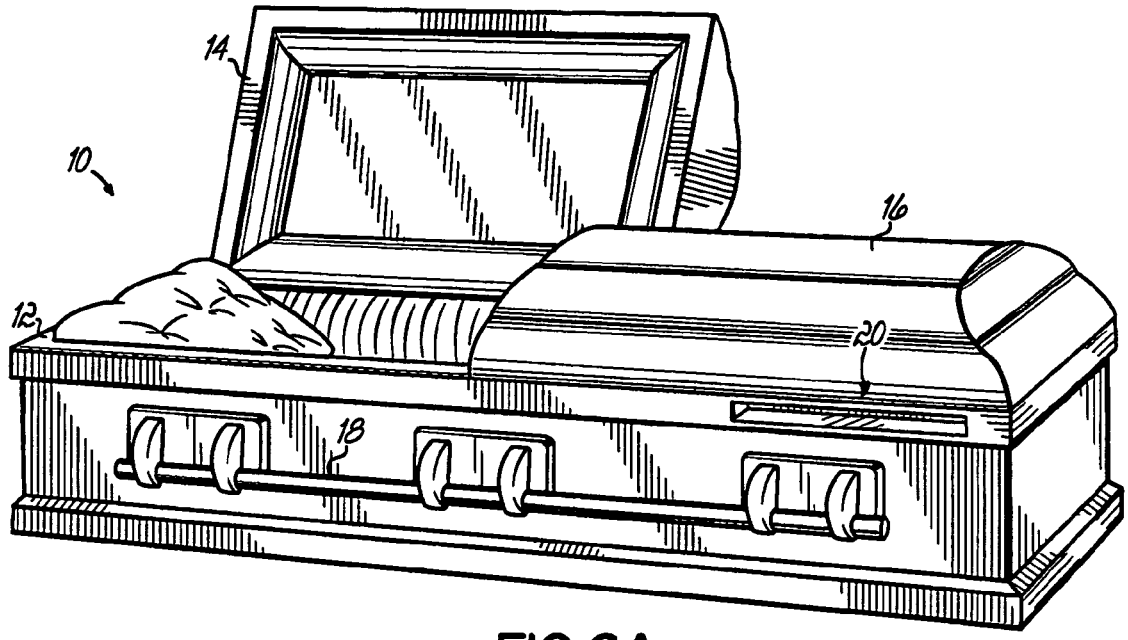
FIGS. 6A and 6B are perspective views of another embodiment.
Figure 6B:
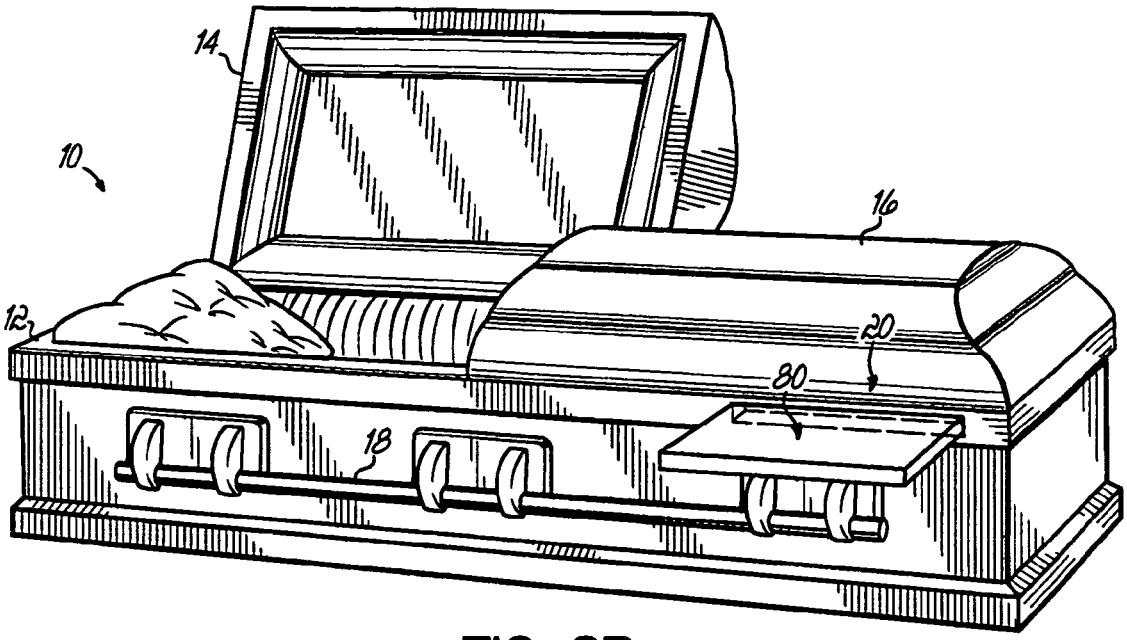
Figure 7:
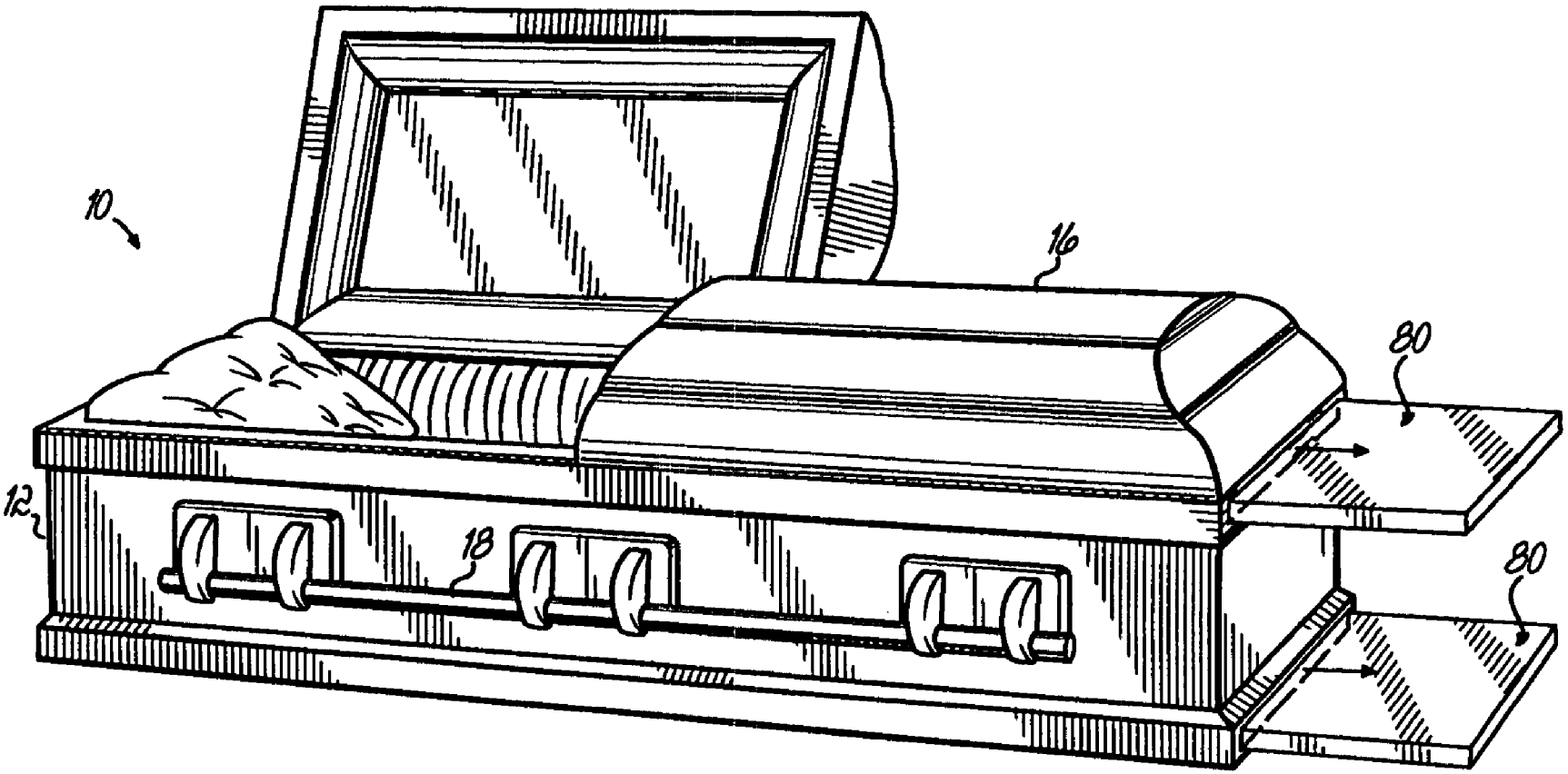
FIG. 7 is a perspective view of another embodiment.

Referring to FIGS. 6A, 6B and 7, structure 20 takes the form of a shelf 70, 80, respectively, slidably mounted in the shell 12, the shelf 70 deployed by pulling the shelf 70 out of the shell 12. The shelf 70 can be mounted in the shell 12 at an upper edge thereof (FIGS. 6A, 6B and 7), the lower edge thereof (FIG. 7), the side thereof (FIGS. 6A and 6B) and/or the end thereof (FIGS. 7).

Figure 8:
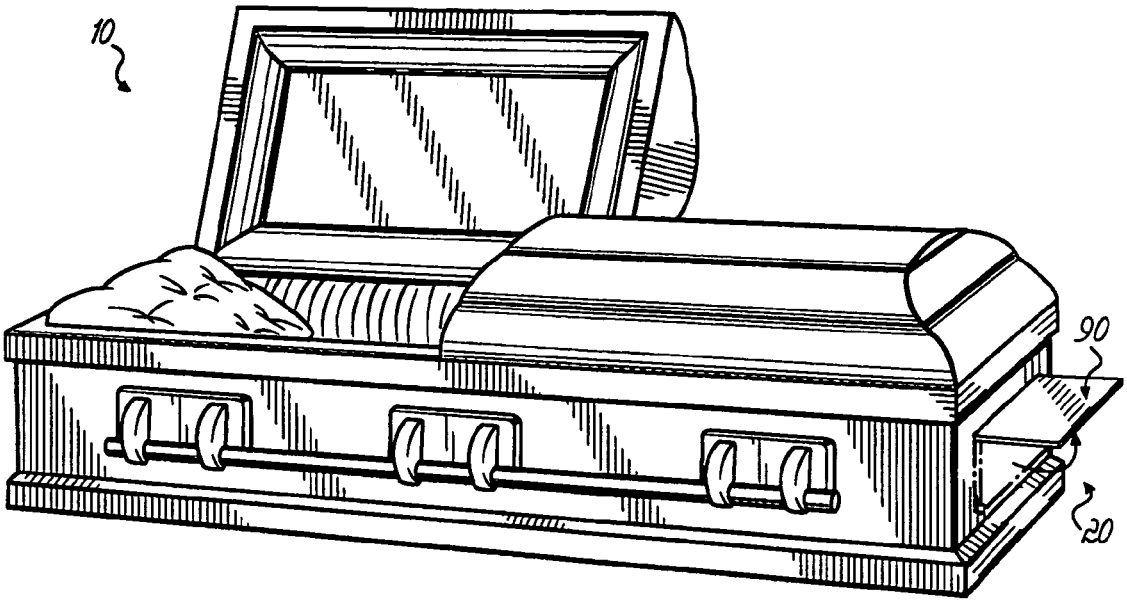
FIG. 8 is a perspective view of another embodiment.

Referring to FIG. 8, structure 20 takes the form of a shelf 90 pivotally mounted to a foot end wall of the shell 12 along an upper edge of the shelf 90. The shelf 90 is deployed by pivoting the shelf 90 away from the foot end wall.

Figure 9:
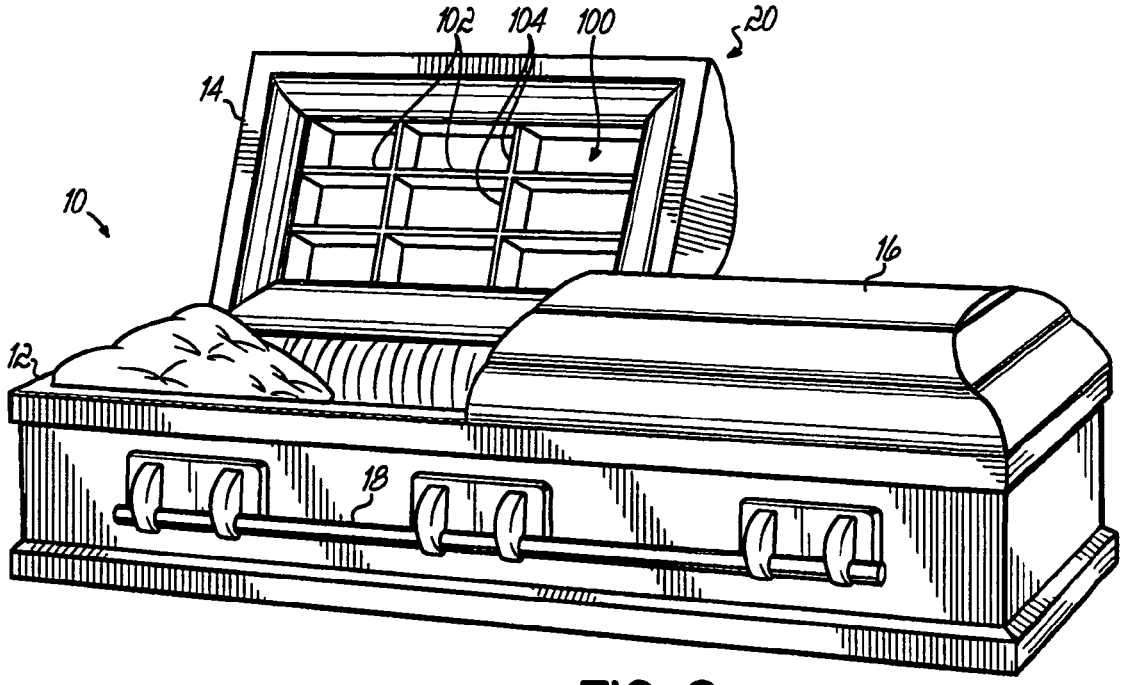
FIG. 9 is a perspective view of another embodiment.
Figure 10:
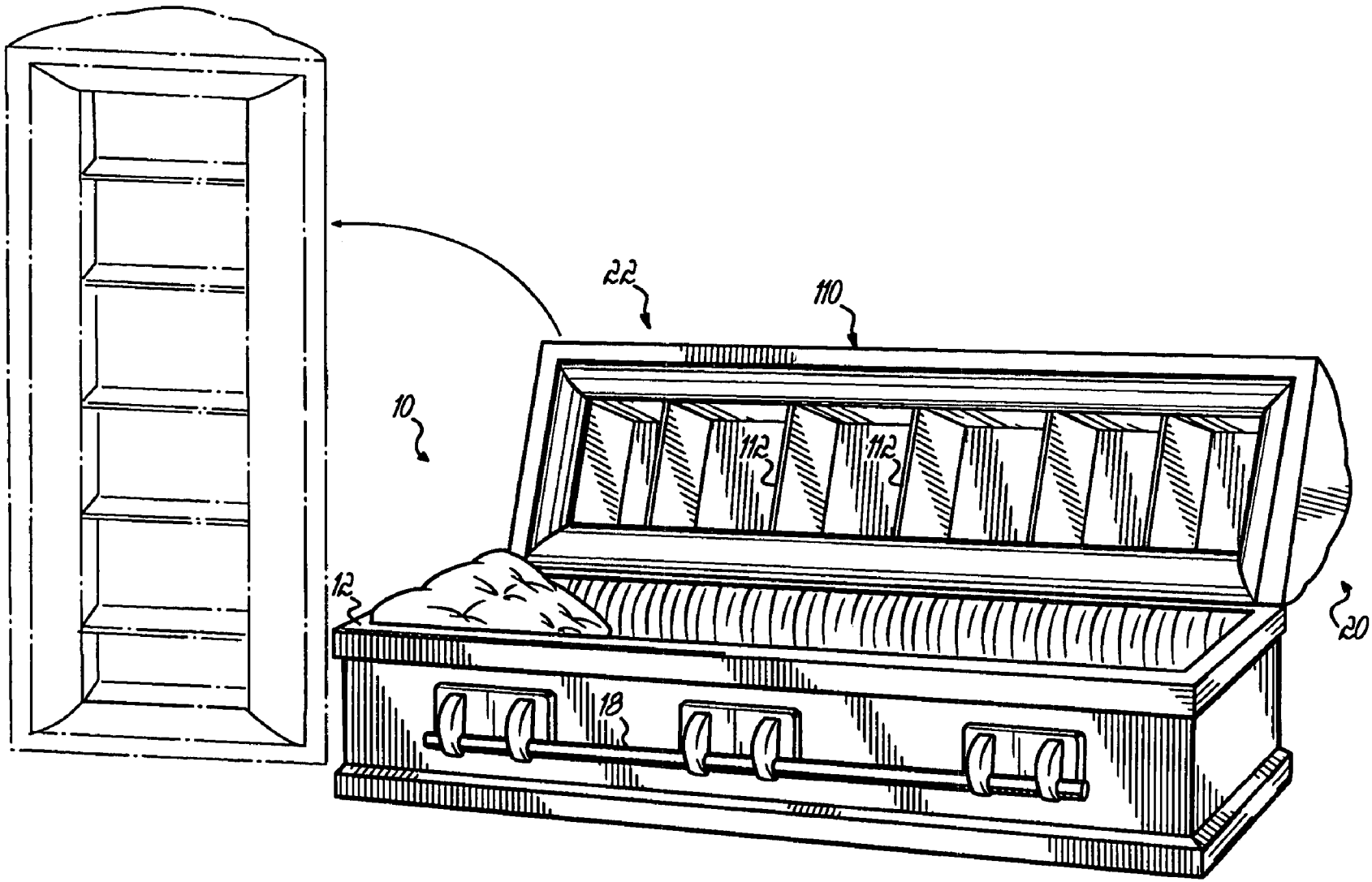
FIG. 10 is a perspective view of another embodiment.

Referring now to FIG. 9, structure 20 takes the form of a shadow box 100 mounted to an underside of head end lid 14. Shadow box 100 has a plurality of horizontal shelves 102 upon which the items of memorialization can be placed and a plurality of vertical divider panels 104 defining, with the shelves 102, a plurality of three dimensional frames within which the items of memorialization can be displayed.

Referring now to FIG. 10, casket 10 has a full length lid 22 which is readily detachable from the shell 12. When detached from shell 12, and stood upright on its end, lid 22 forms an upstanding, freestanding set of shelves 110 upon which the items of memorialization can be displayed. To that end, the lid 22 has a plurality of vertical (when attached to the shell 12) divider panels 112, which form shelves when the lid 22 is stood on its end.

Figure 11A:
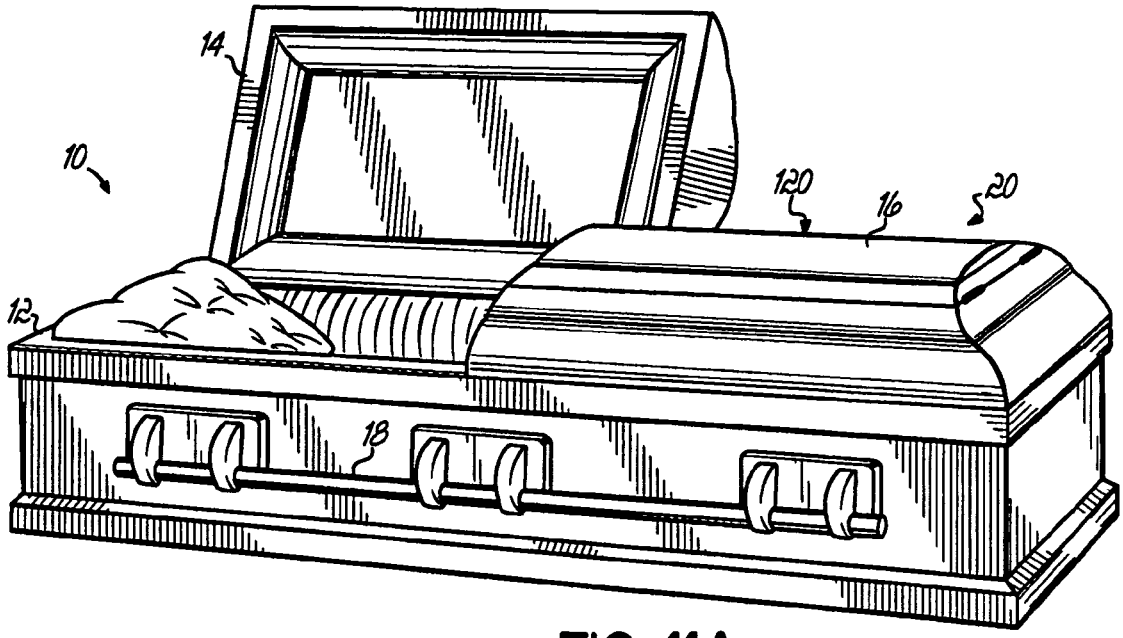
FIGS. 11A and 11B are perspective views of another embodiment.
Figure 11B:
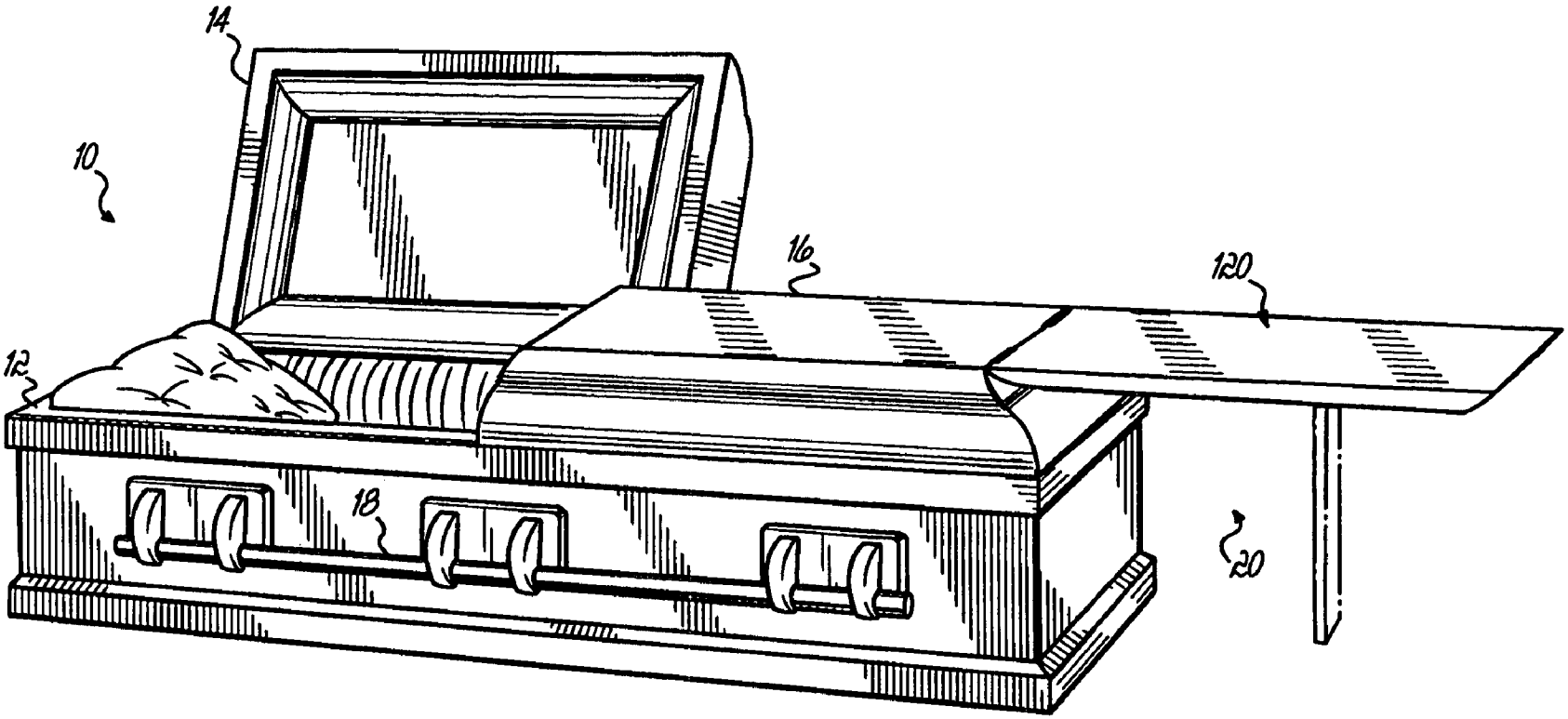

Referring to FIGS. 11A and 11B, foot end lid 16 includes an upper portion forming a shelf 120 pivoted to a lower portion of the lid 16 at a foot end edge thereof. Shelf 120 is deployed by pivoting it relative to the lower portion of the lid 16.

Figure 12A:
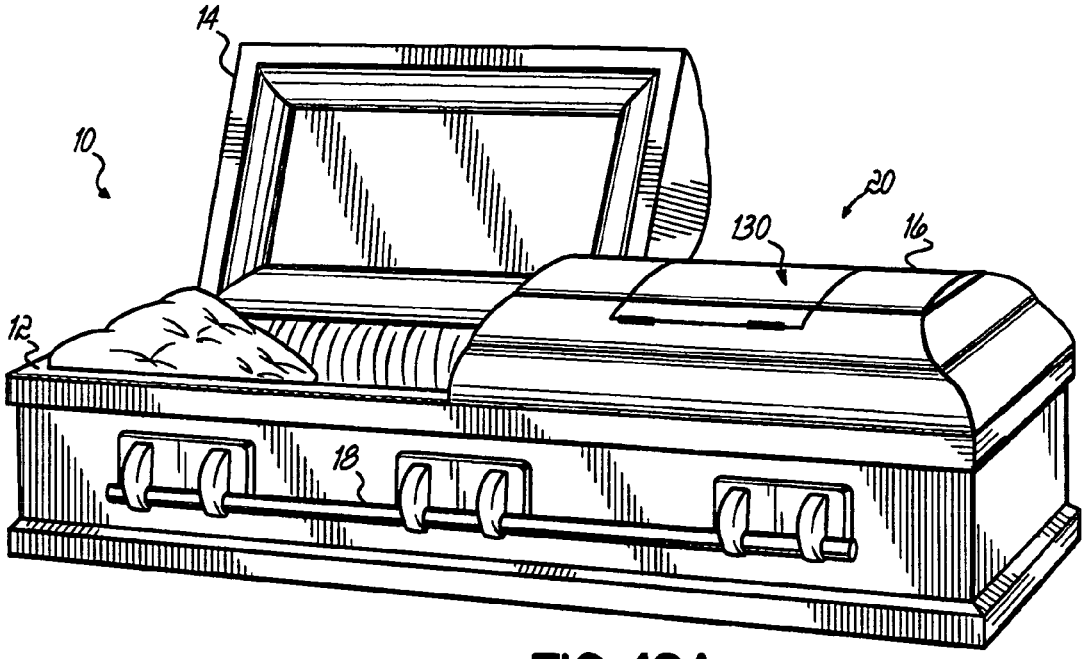
FIGS. 12A and 12B are perspective views of another embodiment.
Figure 12B:
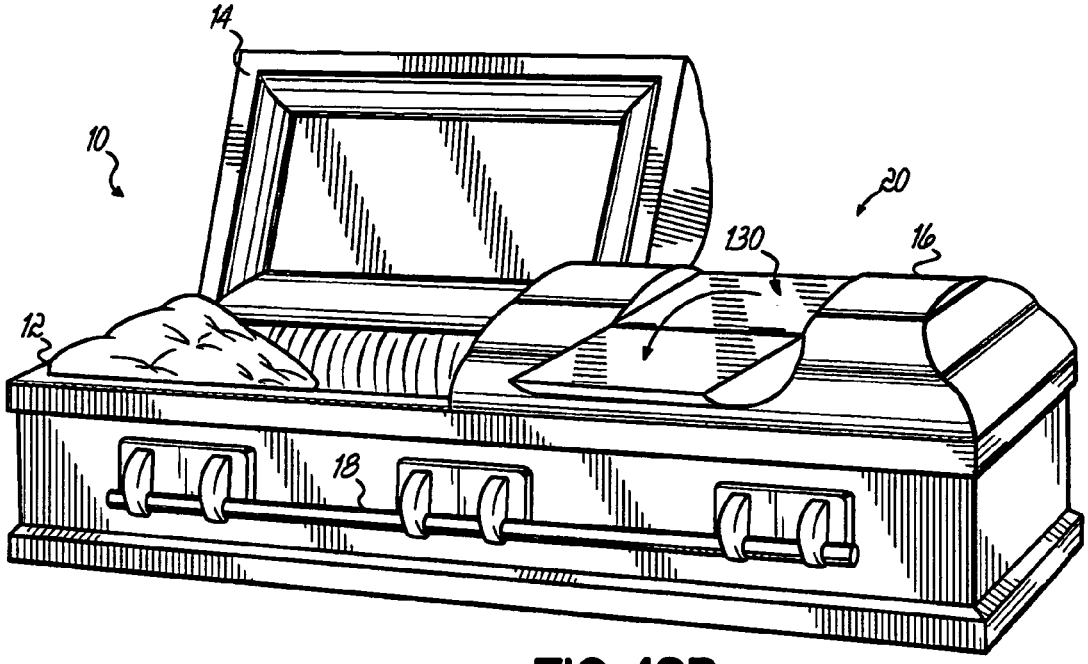

Referring to FIGS. 12A and 12B, foot end lid 16 includes an upper portion forming a shelf 130 pivoted to a lower portion of the lid 16 at a forward side edge thereof. Shelf 130 is deployed by pivoting it relative to the lower portion of the lid 16.

Figure 13:
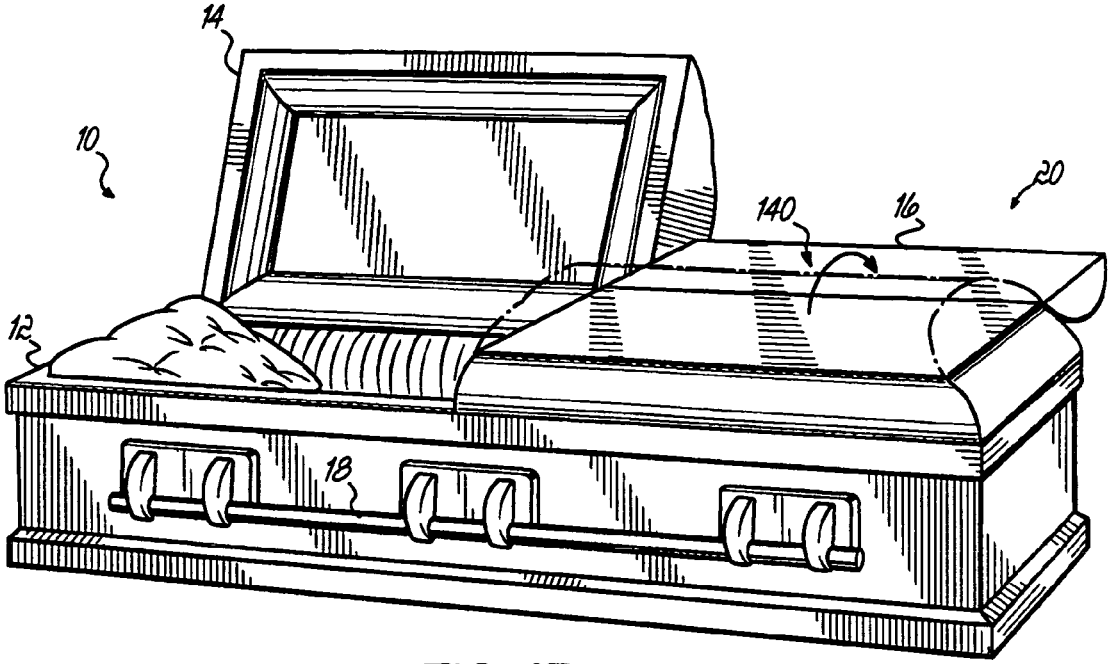
FIG. 13 is a perspective view of another embodiment.

Referring to FIG. 13, foot end lid 16 includes an upper portion forming a shelf 140 pivoted to a lower portion of the lid 16 at a rearward side thereof. Shelf 140 is deployed by pivoting it relative to the lower portion of the lid 16.

Figure 14A:
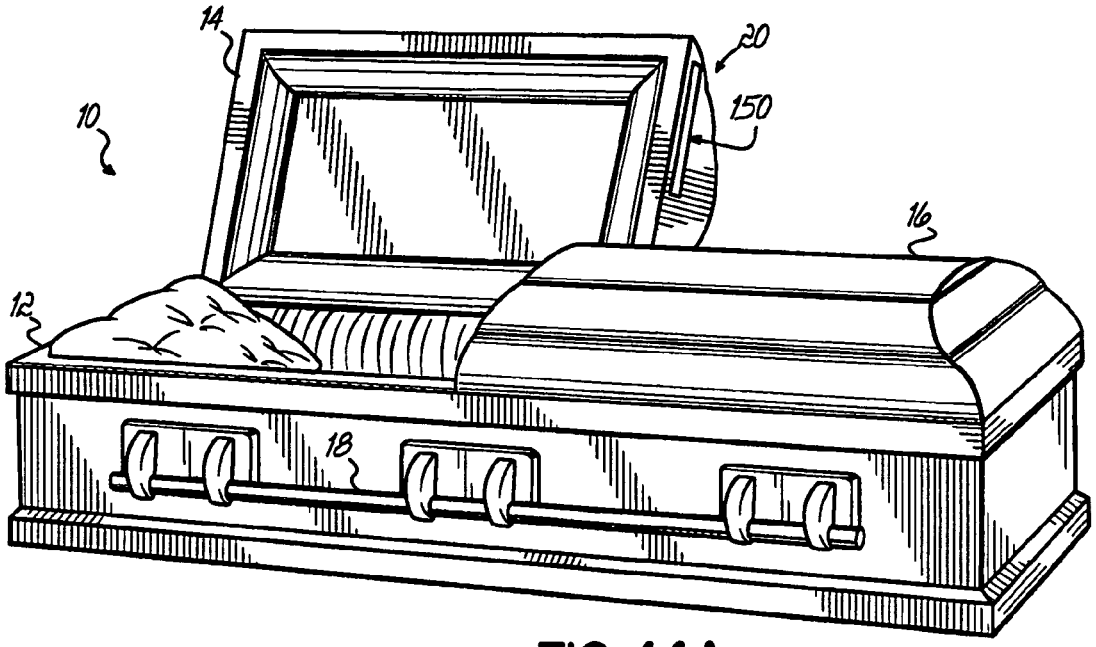
FIGS. 14A and 14B are perspective views of another embodiment.
Figure 14B:
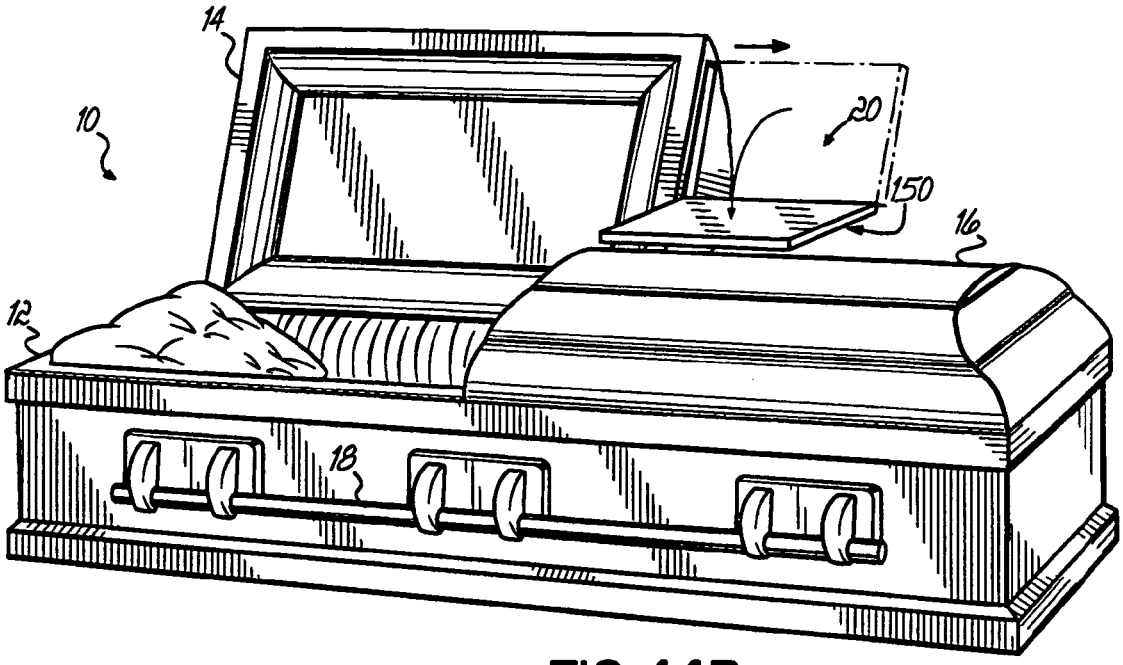

Referring to FIGS. 14A and 14B, head end lid 14 includes a shelf 150 which is both slidably and pivotally mounted therein. Shelf 150 is deployed by first opening head end lid 14, sliding the shelf 150 out of the lid 14 and then pivoting the shelf 150 downwardly relative to the lid 14.

Figure 15A:
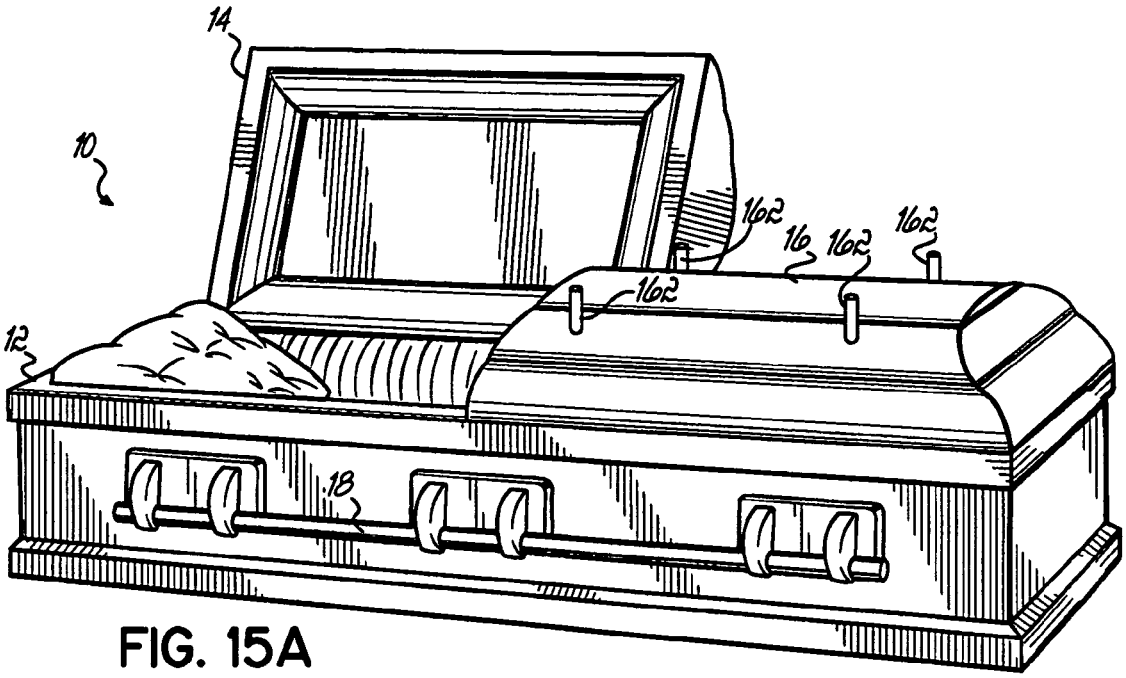
FIGS. 15A and 15B are perspective views of another embodiment.
Figure 15B:
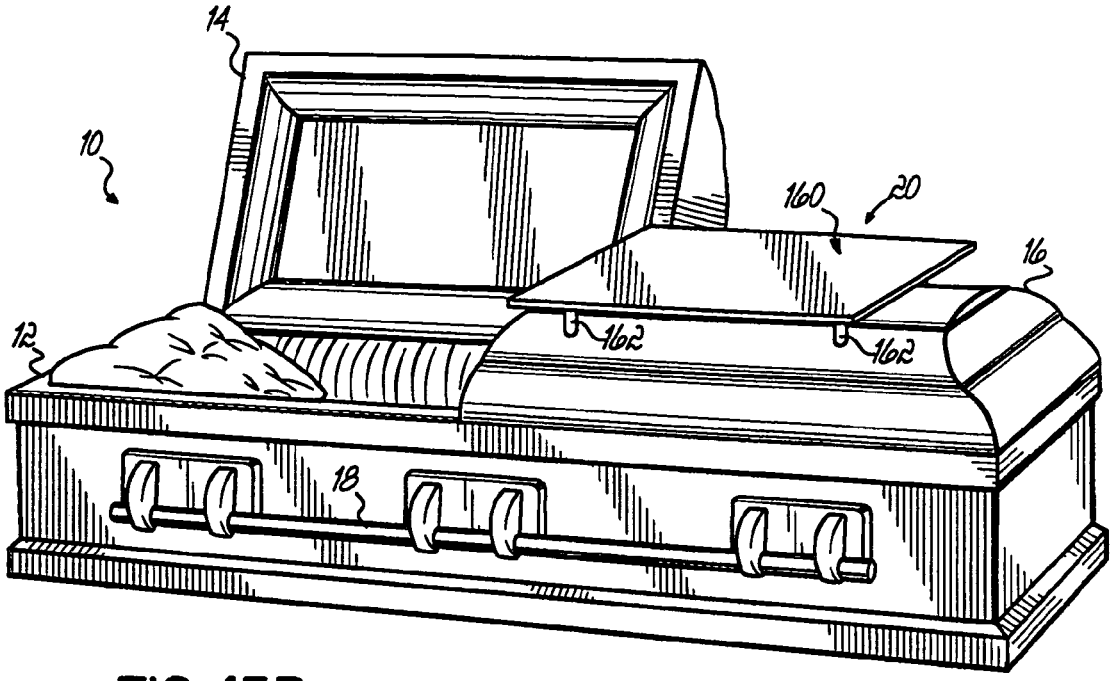

Referring to FIGS. 15A and 15B, foot end lid 16 includes a shelf 160 mounted atop four posts 162, themselves mounted to an upper surface of lid 16.

Figure 16:
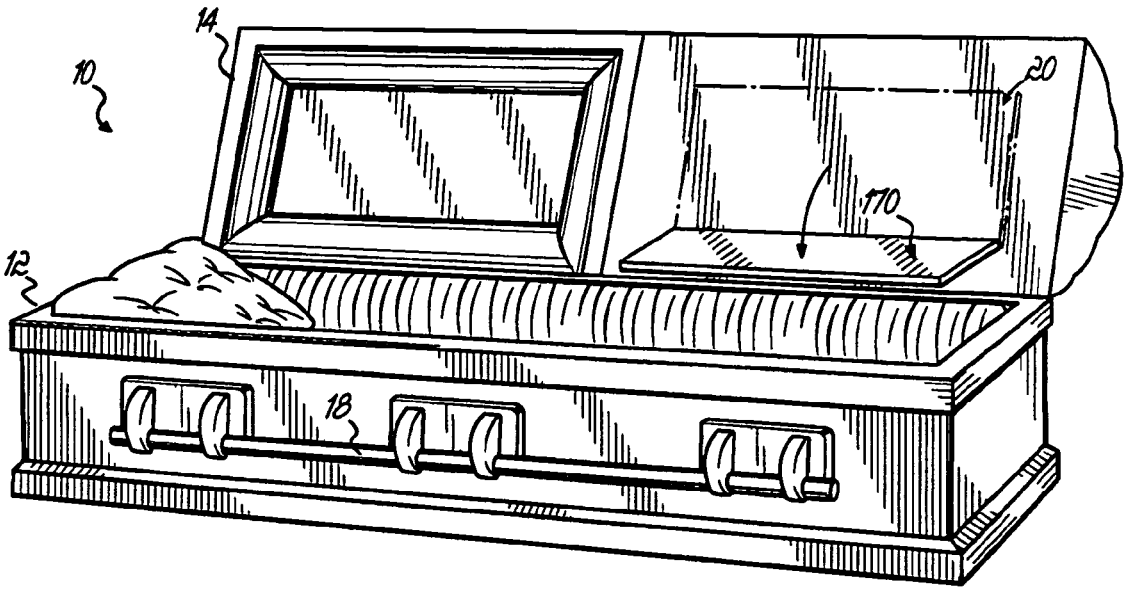
FIG. 16 is a perspective view of another embodiment.

Referring to FIG. 16, foot end lid 16 (as illustrated) includes a shelf 170 pivotally mounted to an underneath side of the lid 16 along a lower edge of the shelf 170. Shelf 170 is deployed by opening the foot end lid 16 and pivoting the shelf 170 downwardly relative to the lid 16.

Figure 17A:
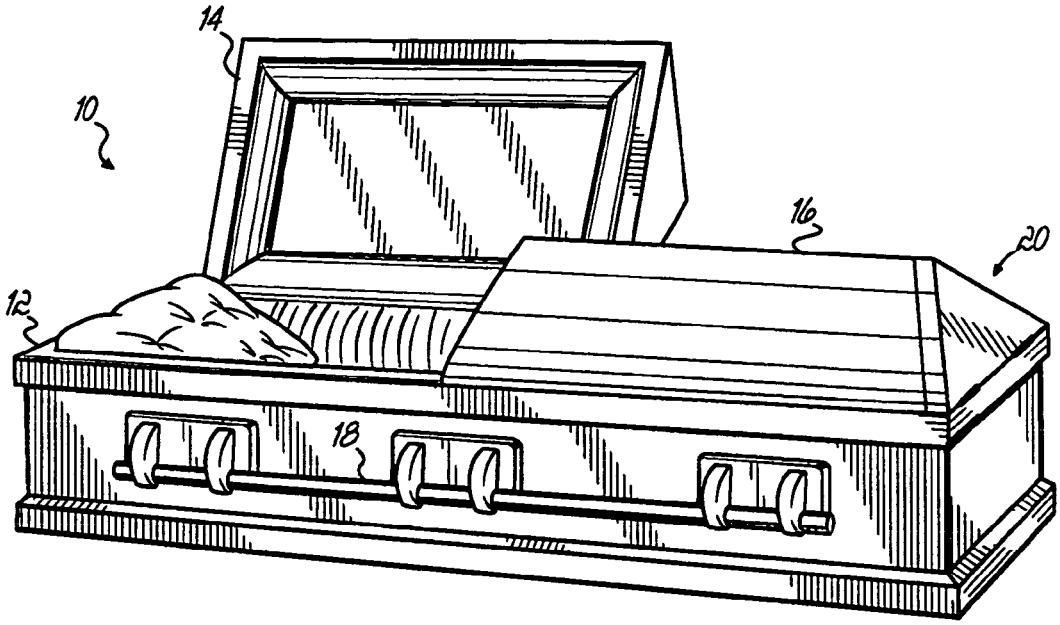
FIGS. 17A-17C are perspective views of another embodiment.
Figure 17B:
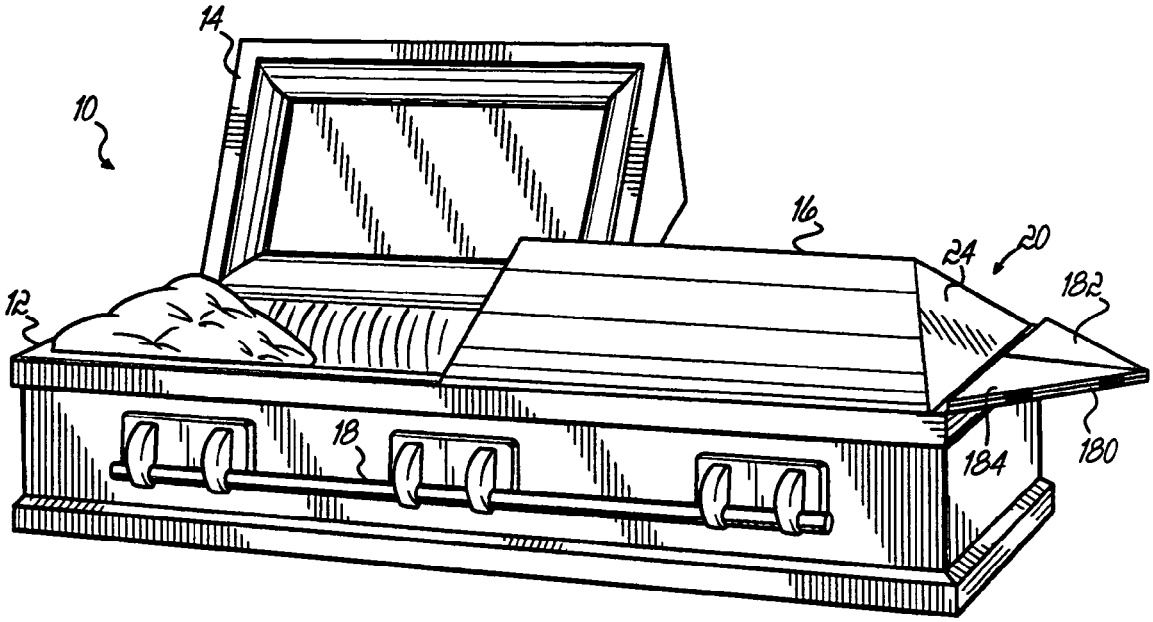
Figure 17C:
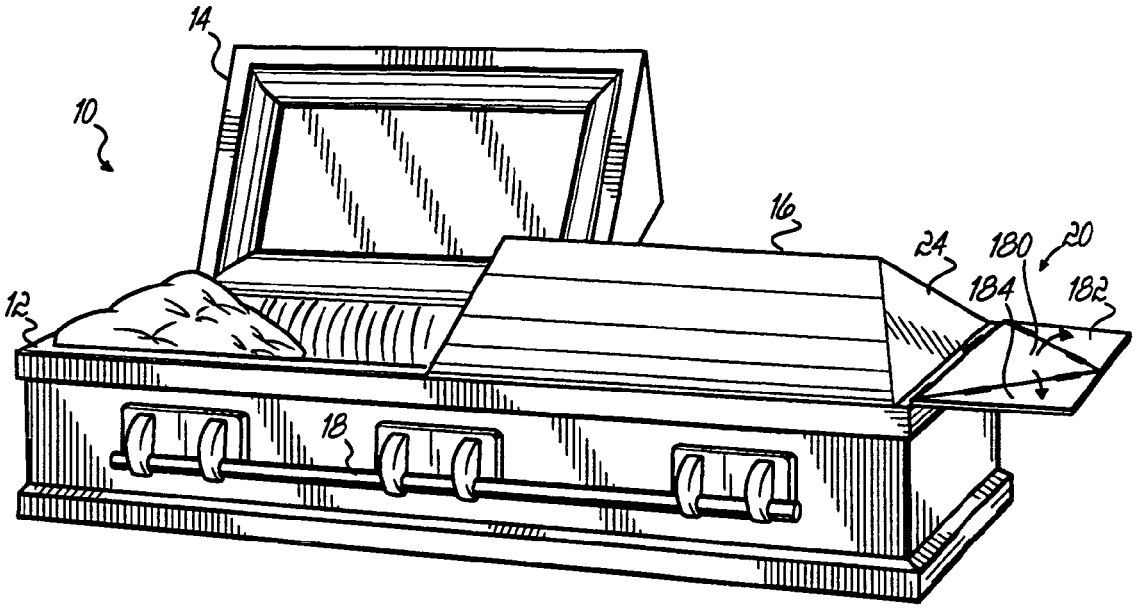

Referring to FIGS. 17A-17C, foot end lid 16 includes an end panel 24 and a shelf 180 pivotally mounted to end panel 24 along a lower edge of the shelf 180. The shelf 180 is adapted to be deployed by pivoting the shelf 180 away from the end panel 24. The shelf can comprise three sections, first section 180 pivoted to end panel 24, and second and third sections 182, 184 pivoted to the first section 180 at opposite side edges of the first section 180. In that case the shelf is deployed by pivoting the first section. 180 away from the end panel 24 and by pivoting the second and third sections 182, 184 relative to the first section 180 to thereby form a substantially planar shelf out of the first, second and third sections.

Figure 18:
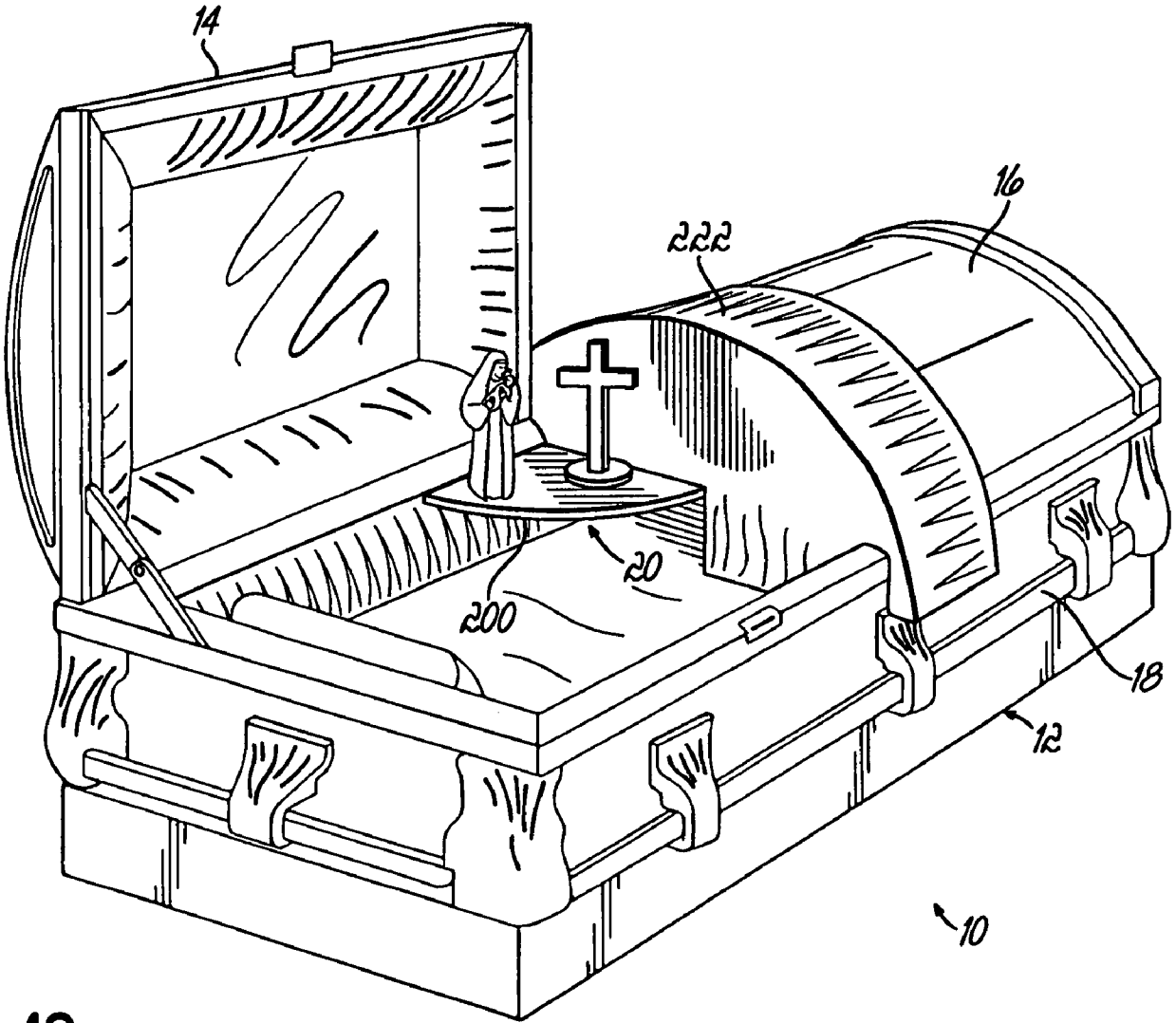
FIG. 18 is a perspective view of another embodiment with head end lid open and foot end lid closed, and with the memorial shelf extended.
Figures 19, 19A:
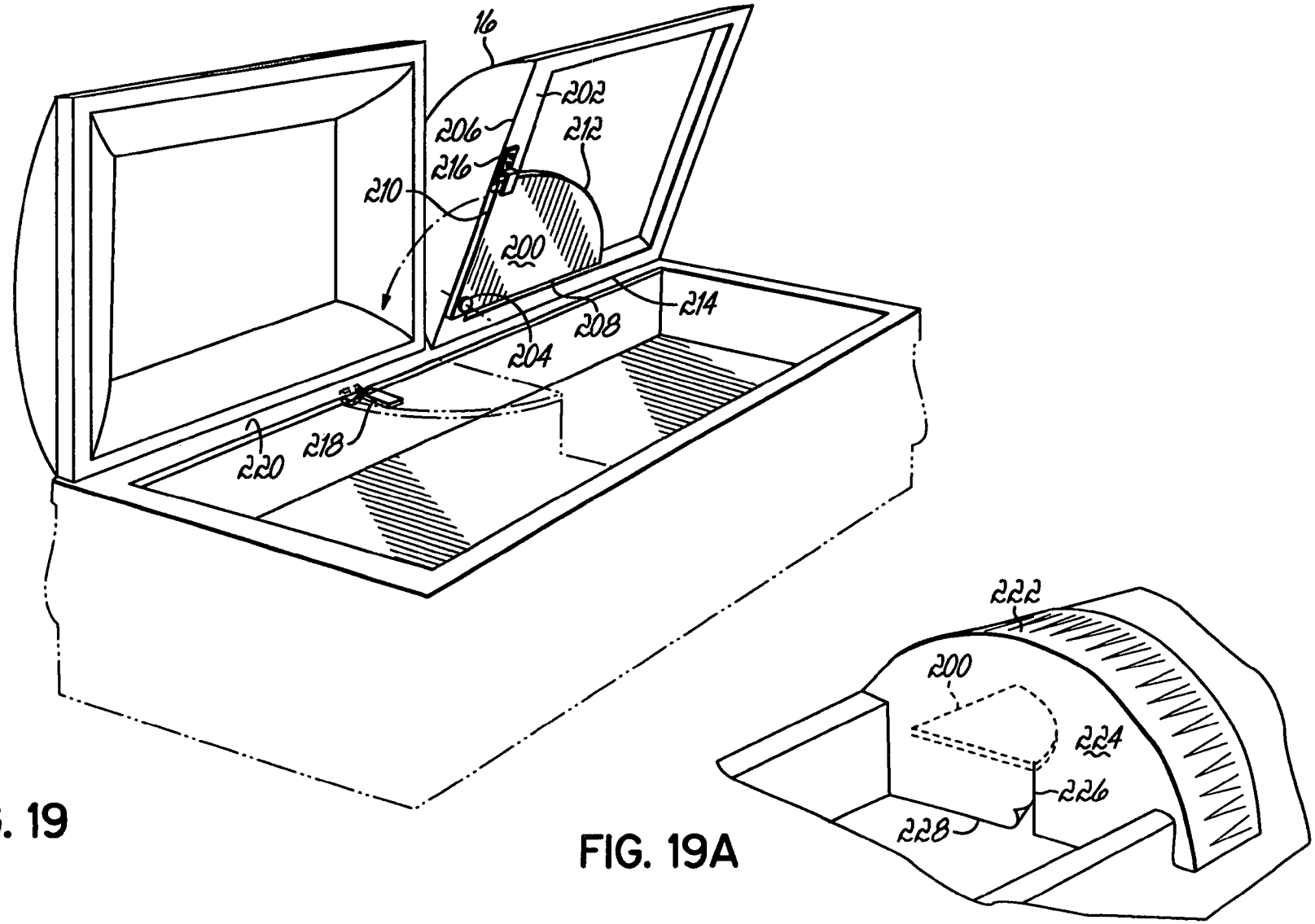
FIG. 19 is a view similar to FIG. 18 but with the foot end lid also open and the memorial shelf retracted.
FIG. 19A is a partial perspective view, similar to FIG. 18, but with the memorial shelf retracted.

Referring now to FIGS. 18,19, and 19A, there is illustrated another embodiment of deployable structure 20 which, when deployed, defines a memorial surface adapted to have placed thereon items of memorialization. More particularly, a memorial shelf 200 is pivoted to one of the lids 14, 16 and is movable to and between an extended position (FIG. 18) at which said shelf 200 is adapted to support items of memorialization and a retracted position (FIG. 19).

The lid to which the shelf 200 is mounted, for example foot end lid 16, can have a downwardly facing flange 202 to which the shelf 200 can be pivoted as at pivot 204. The shelf 200 can be pivoted to the foot end lid flange 202 adjacent a head end edge 206 thereof. The shelf 200 can be pie-shaped. The pie-shaped shelf 200 can have two straight sides 208, 210, and an arcuate side 212. The shelf 200 can be pivoted to the foot end lid 16 adjacent where the two straight sides 208, 210 intersect. The foot end lid 16 can be pivoted to the shell 12 with hinges (not shown) along a hinge side 214 of the lid 16. The pie-shaped shelf 200 can be pivoted to the foot end lid 16 adjacent the hinge side 214 of the lid 16. The lid 16 can include a brace 216 which supports the shelf 200 when in the extended and/or retracted position. The shell 12 can include a brace 218, for example a removable brace 218 which fits over or otherwise removably attaches to an edge 220 of shell which supports the shelf 200 when in the extended position. The brace 218 and shelf 200 can include cooperating locking structure, for example, a detent type mechanism wherein one of the shelf 200 and brace 218 include one or more nubs or protuberances thereon, and the other of the shelf 200 and brace 218 include one or more recesses for the nubs or protuberances to engage, thereby locking the shelf 200 into place.

Referring to FIGS. 18 and 19A, an overthrow 222 can overlie the head end portion of the foot end lid 16 and can have a skirt 224 which drapes downwardly from the lid 16 and into the shell 12 for concealing the legs of a deceased therein. Skirt 224 can include a slit 226 therein extending upwardly from a lowermost edge 228 of the skirt 224 of the overthrow 222. The portion of the skirt 224 on the side of the shelf 200 can be folded back underneath the head end portion of the foot end lid 16 between it and the shelf 200 during the time that the shelf 200 is in the extended position. When in the retracted position, that portion of the skirt 224 can be allowed to hand downwardly into the shell 12, thereby concealing the shelf 200.

Referring now to FIGS. 20-42, various additional embodiments of the invention are illustrated. In the FIGS. 20-42 embodiments, unlike the prior embodiments described above, the structure defining the memorial surface is not integrally formed with the casket, i.e. is a separate item readily removable from the casket.

Figure 20:
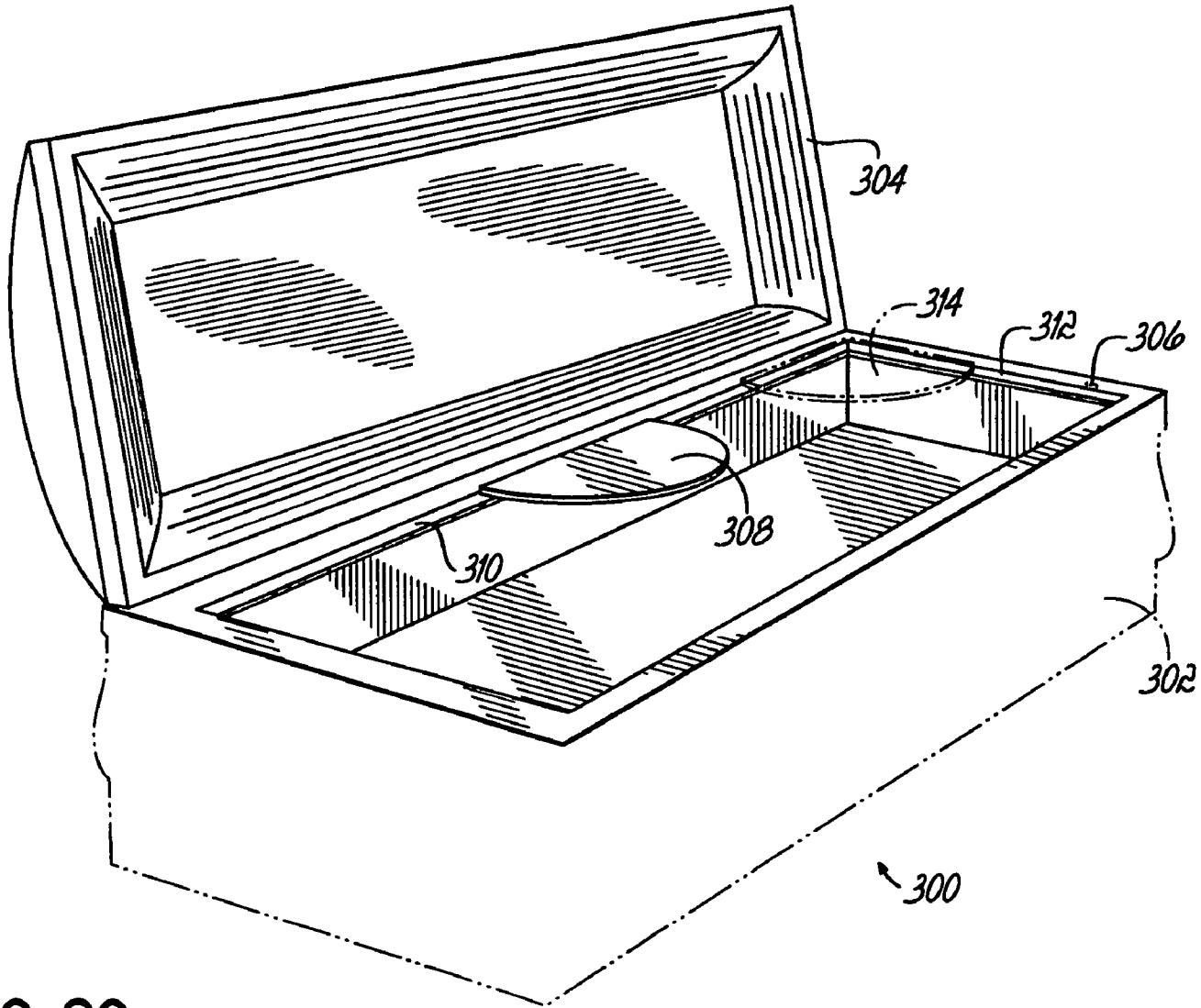
FIGS. 20-44 are various views of various additional embodiments.

As illustrated in FIG. 20, a casket 300 has a shell 302 and a lid 304 closeable upon the shell 302. The particular style of casket 300 illustrated in FIG. 20 is a so-called "full couch" casket, i.e. a casket with a single casket lid that covers an entirety of the interior of the shell of the casket. The invention is not however to be limited to full couch caskets, as the invention can readily be practiced with so-called "split top" or "half couch" caskets, i.e. caskets that have a pair of lids, a foot end lid and a head end lid.

More particularly, shell 302 includes an upper edge 306. A memorial shelf 308 is connected to the upper edge 306 of the shell 302, and is adapted to support items of memorialization thereon. The memorial shelf 308 can be mounted to a side 310 of the shell 302, or alternatively can be mounted to a side 310 of the shell 302 and to an adjacent end 312 of the shell 302, i.e. in the comer of the shell 302. In the case of the former, the memorial shelf 308 can be semi-circular shaped, and in the case of the latter the memorial shelf can be pie-shaped as illustrated at 314.

Figure 21:
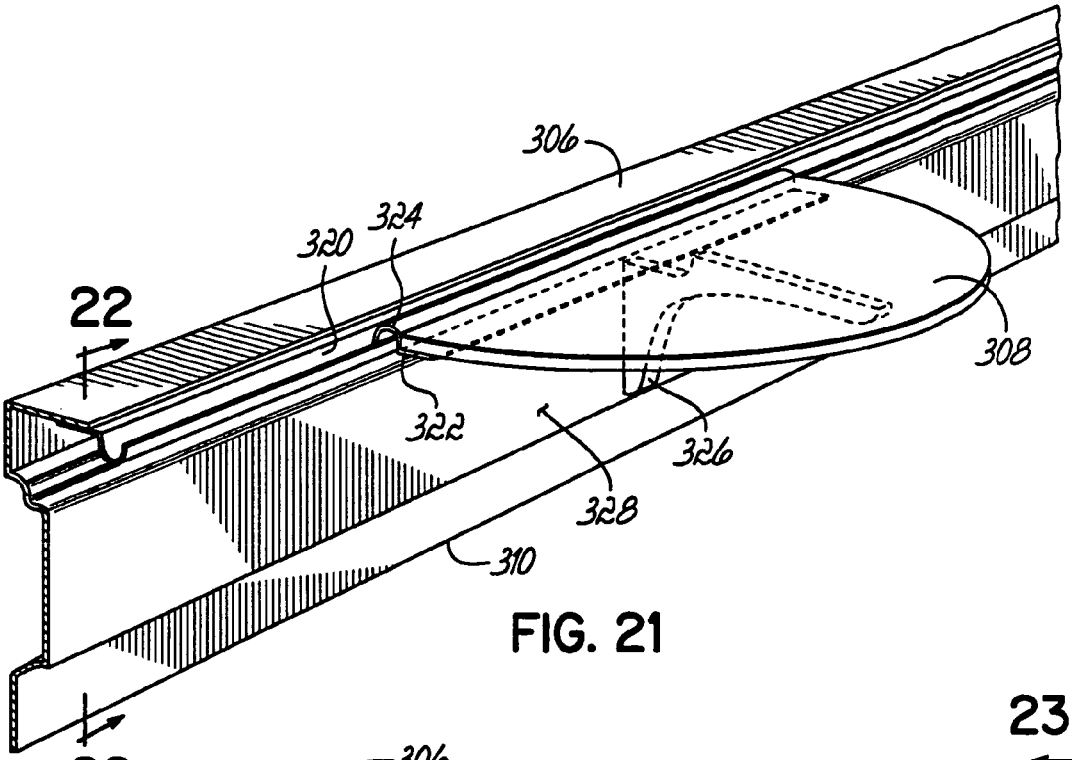
Figure 22:
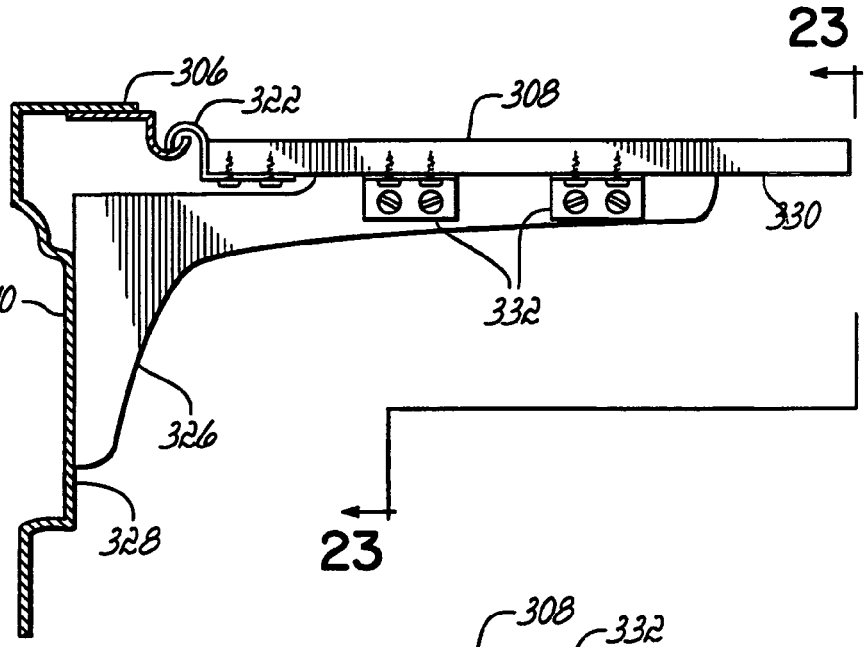
Figure 23:
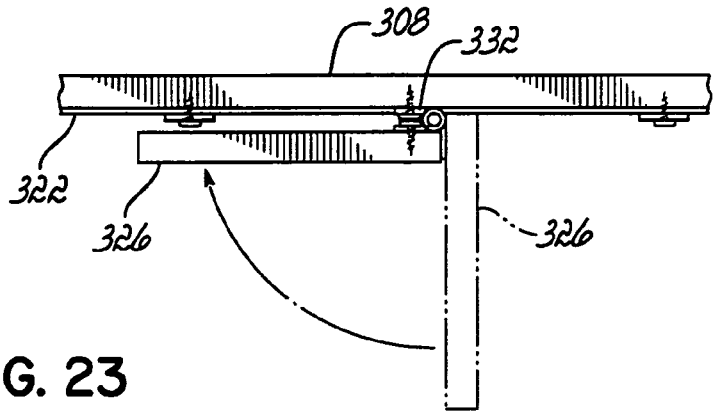

Referring now to FIGS. 21-23, upper edge 306 of shell 302 can have an upturned lip 320 thereon. The shelf 308 can have a bracket 322 mounted thereon having a downturned lip 324 thereon. The downturned lip 324 on the shelf bracket 322 can be supported on the upturned lip 320 of the upper edge 306 of the shell 302. The shelf 308 can have a brace 326 mounted thereto. The brace 326 can contact an interior wall 328 of the shell 302 and support the shelf 30. The brace 326 can be attached to an underneath side 330 of the shelf 308 by one or more hinges 332. In that way the brace 326 can be folded to and between a shelf supporting position generally perpendicular to the shelf 308 and a storage position generally parallel and abutting the shelf 308.

Figure 24:
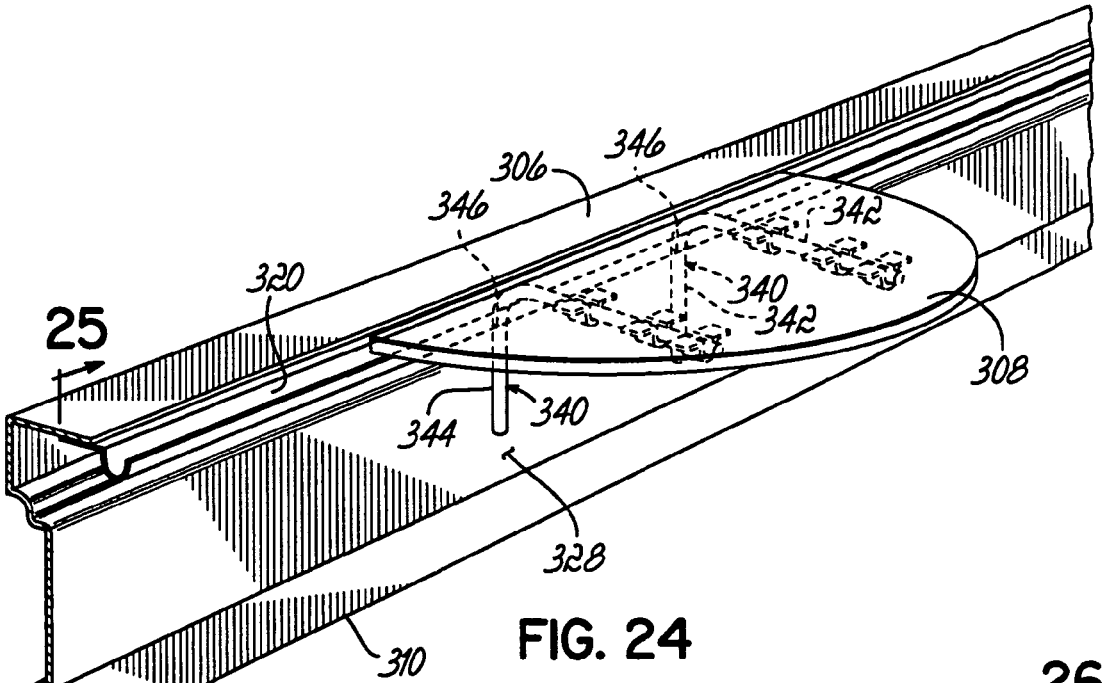
Figure 25:
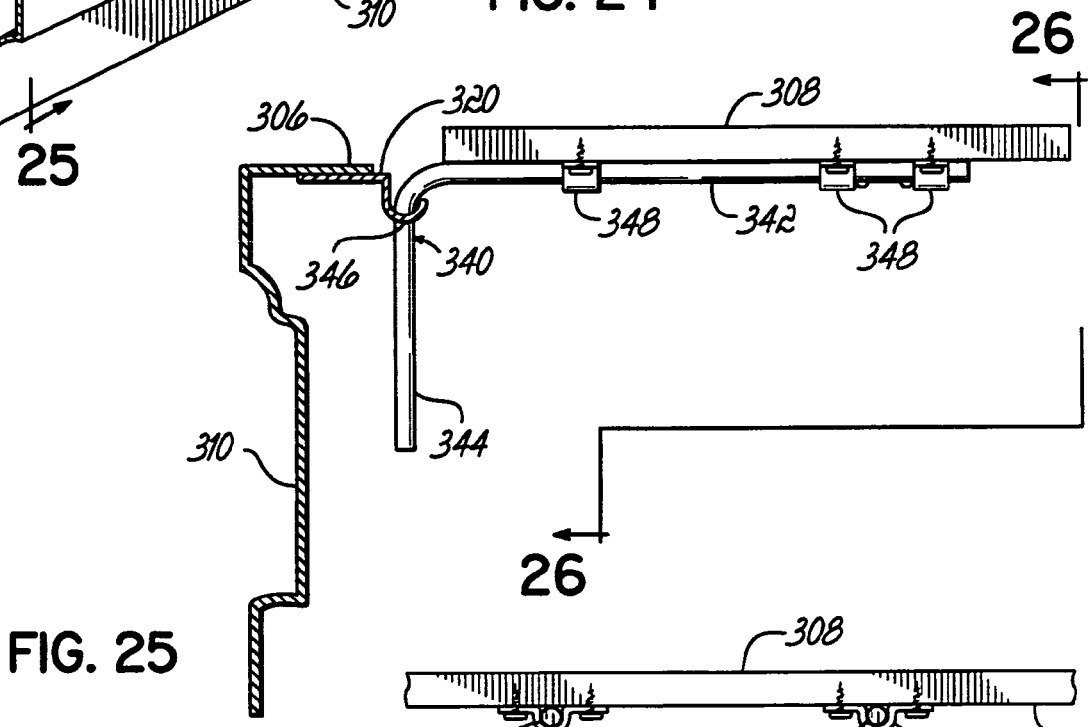
Figure 26:
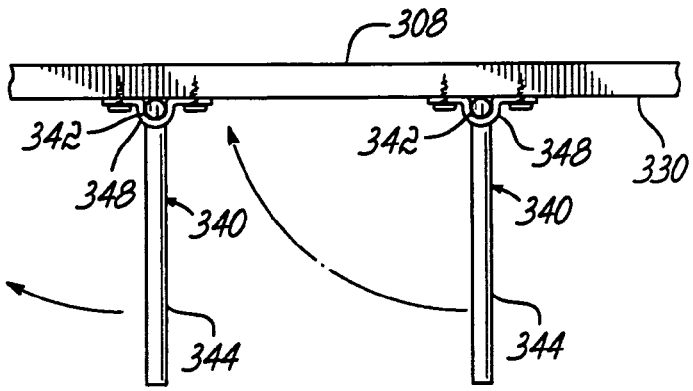

Referring now to FIGS. 24-26, the shelf 308 can include a pair of L-shaped rods 340 mounted thereto. The rods 340 can each have a leg 342 and a foot 344. The leg 342 can be mounted to the shelf 308 and the foot 344 can extend downward into the upper edge 306 of the shell 302, for example through a hole 346 in the upturned lip 320 of the upper edge 306 of the shell 302. The rods 340 can be circular in cross-section, and can be mounted to the underneath side 330 of the shelf 308 with semi-circular brackets 348. In that way the rods 340 can be folded to and between a shelf supporting position generally perpendicular to the shelf 308 and a storage position generally parallel and abutting the shelf 308.

Figure 27:
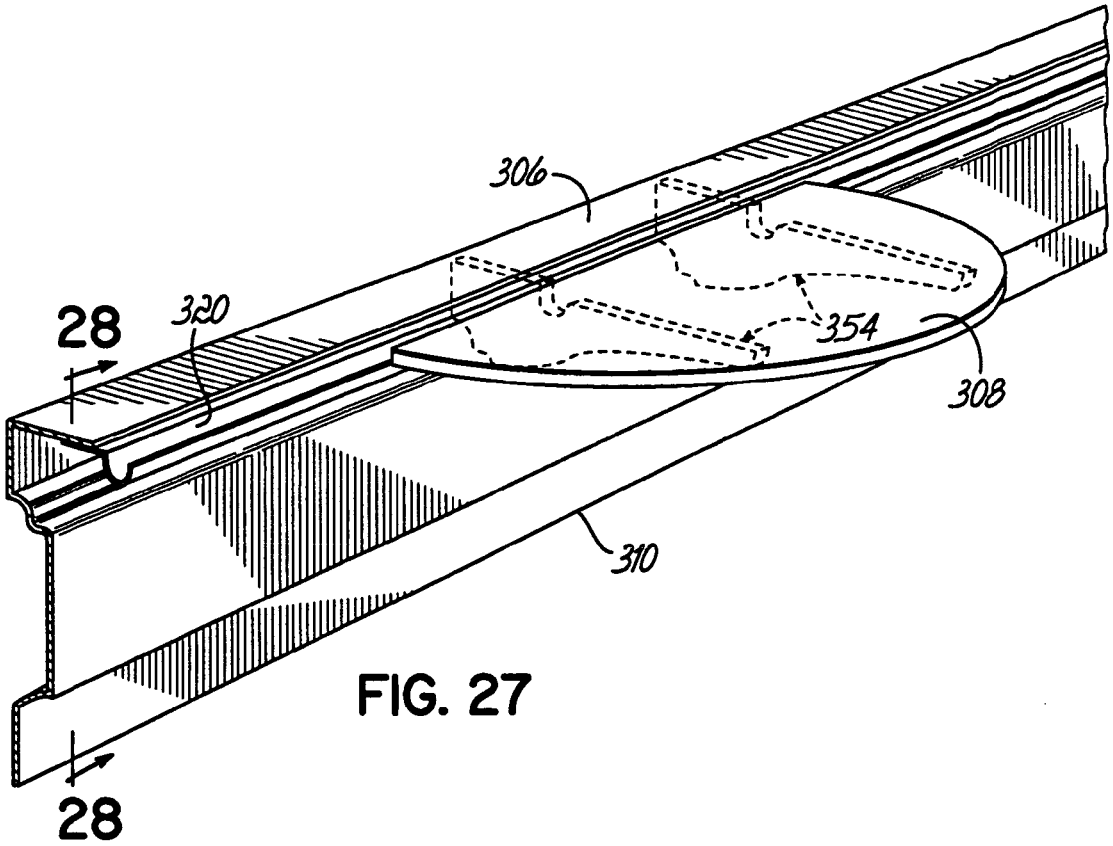
Figure 28:
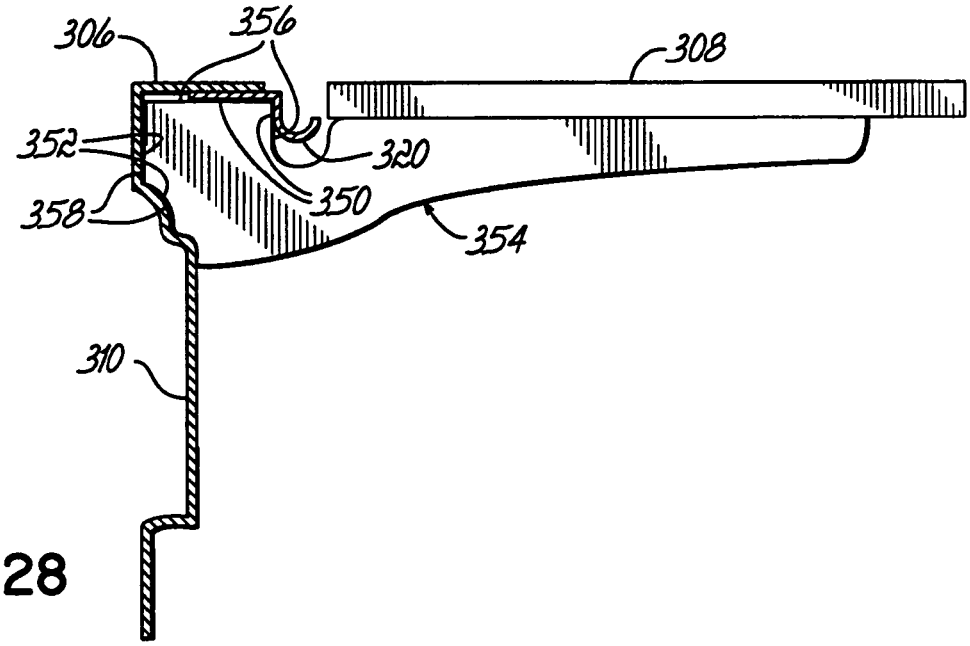

Referring now to FIGS. 27 and 28, the upper edge 306 of the shell 302 can be formed to include first and second surfaces 350, 352. The shelf 308 can have a pair of braces 354 mounted thereon, each having first and second surfaces 356, 358 which cooperated with the first and second surfaces 350, 352 of the edge 306 of the shell 302 to thereby provide moment load carrying capability for the braces 354 and hence shelf 308.

Figure 29:
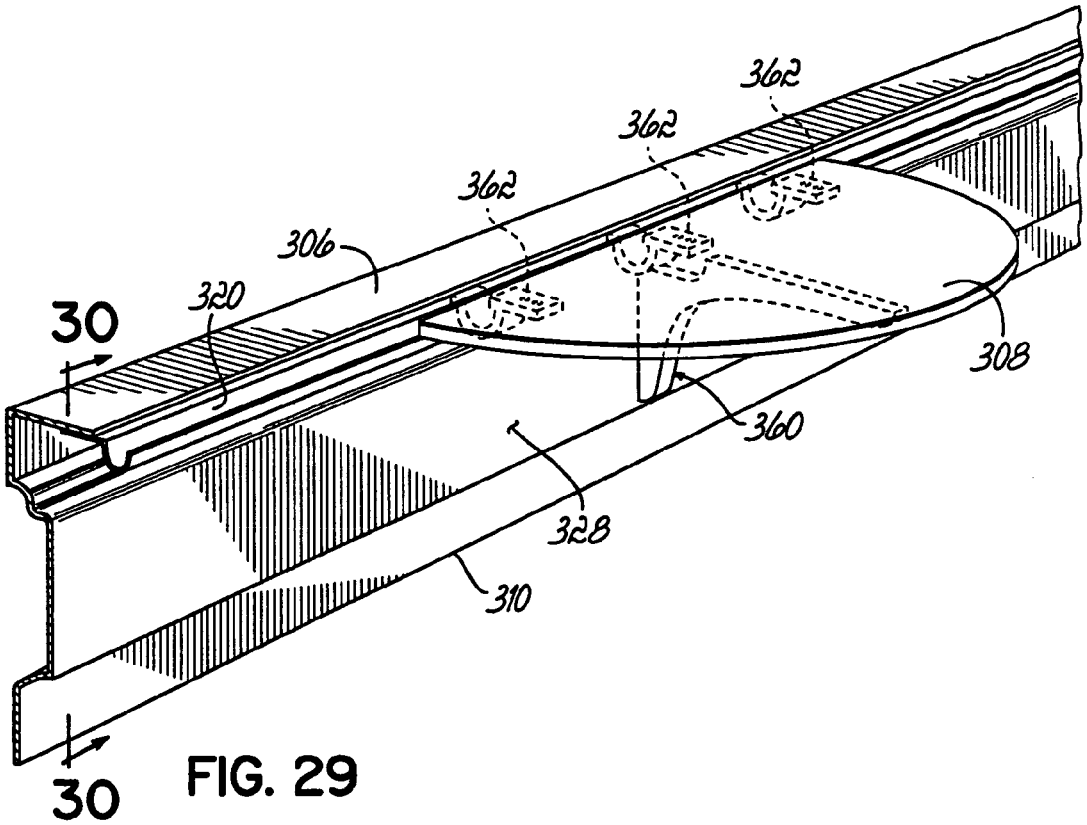
Figure 30:
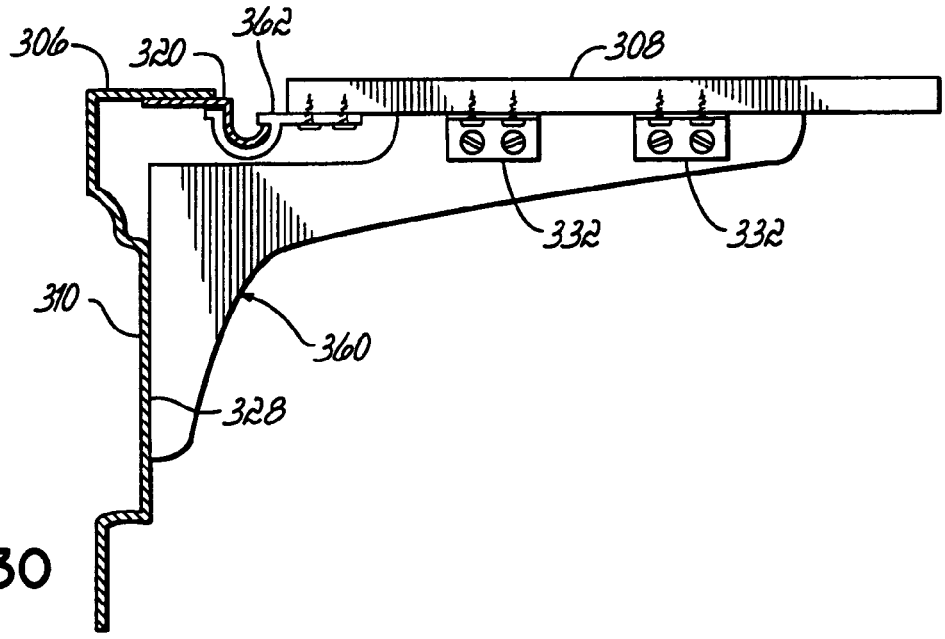

Referring now to FIGS. 29 and 30, the shelf 308 can have a brace 360 and two or more upturned brackets 362 mounted thereto. The brace 360 can contact an interior wall 328 of the shell 302 and the brackets 362 can receive therein the upturned lip 320 of the upper edge 306 of the shell 302 to thereby support the shell 308.

Figure 31:
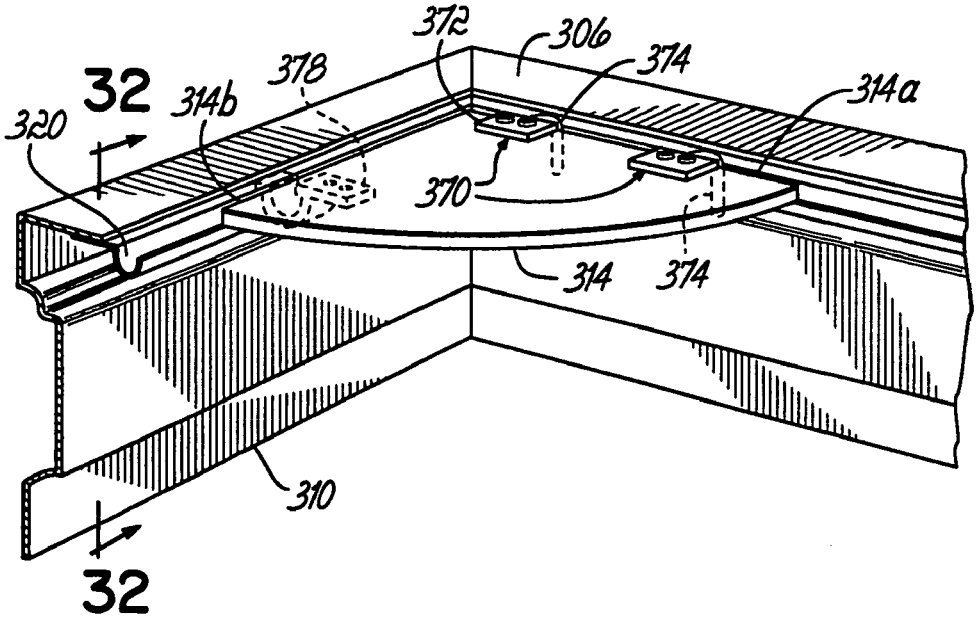
Figure 32:
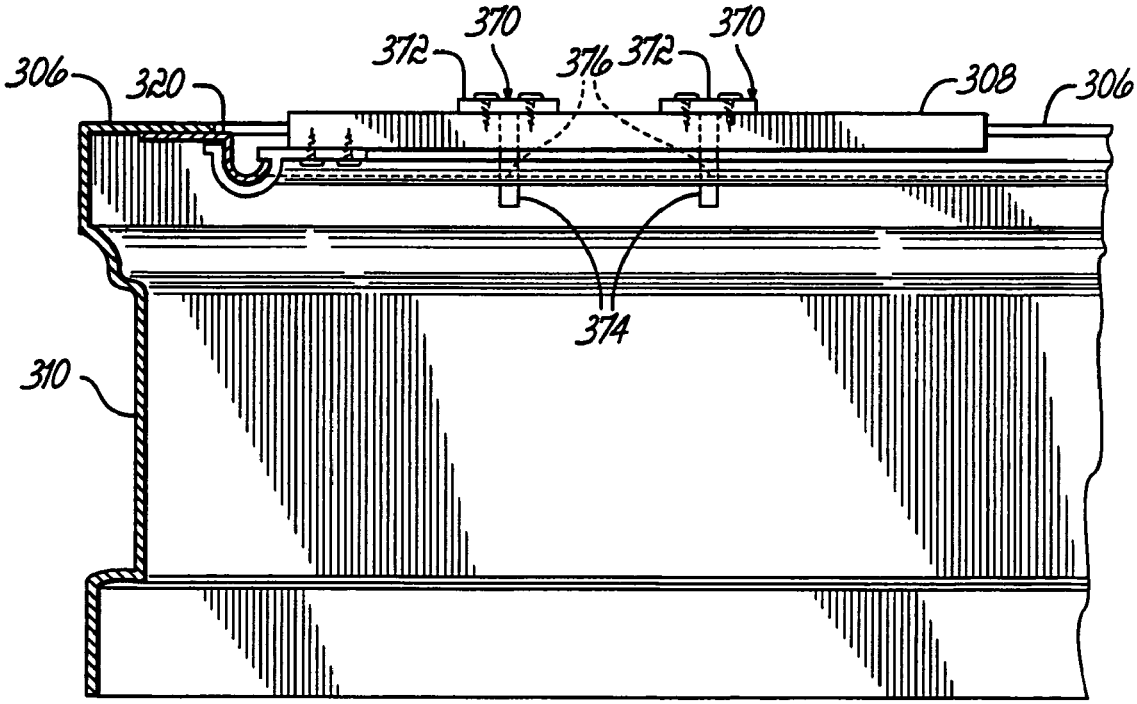

Referring now to FIGS. 31 and 32, one edge 314*a* of shelf 314 can have at least one L-shaped rod 370 mounted thereto. The rod 370 can have a leg 372 and a foot 374. The leg 372 can be mounted to the shelf 314, and the foot 374 can extend downward through a hole 376 in the upper edge 306 of the shell 302. The other edge 314*b* of the shelf 314 can have at least one upturned bracket 378 mounted thereto, the bracket 378 receiving therein the upturned lip 320 of the upper edge 306 of the shell 302 to thereby support the shelf 314.

Figure 33:
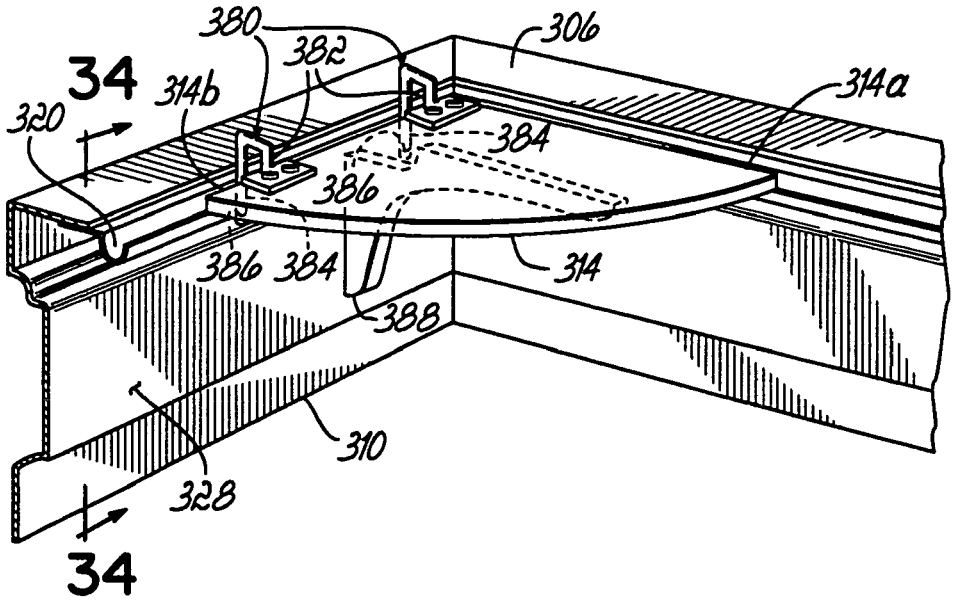
Figure 35:
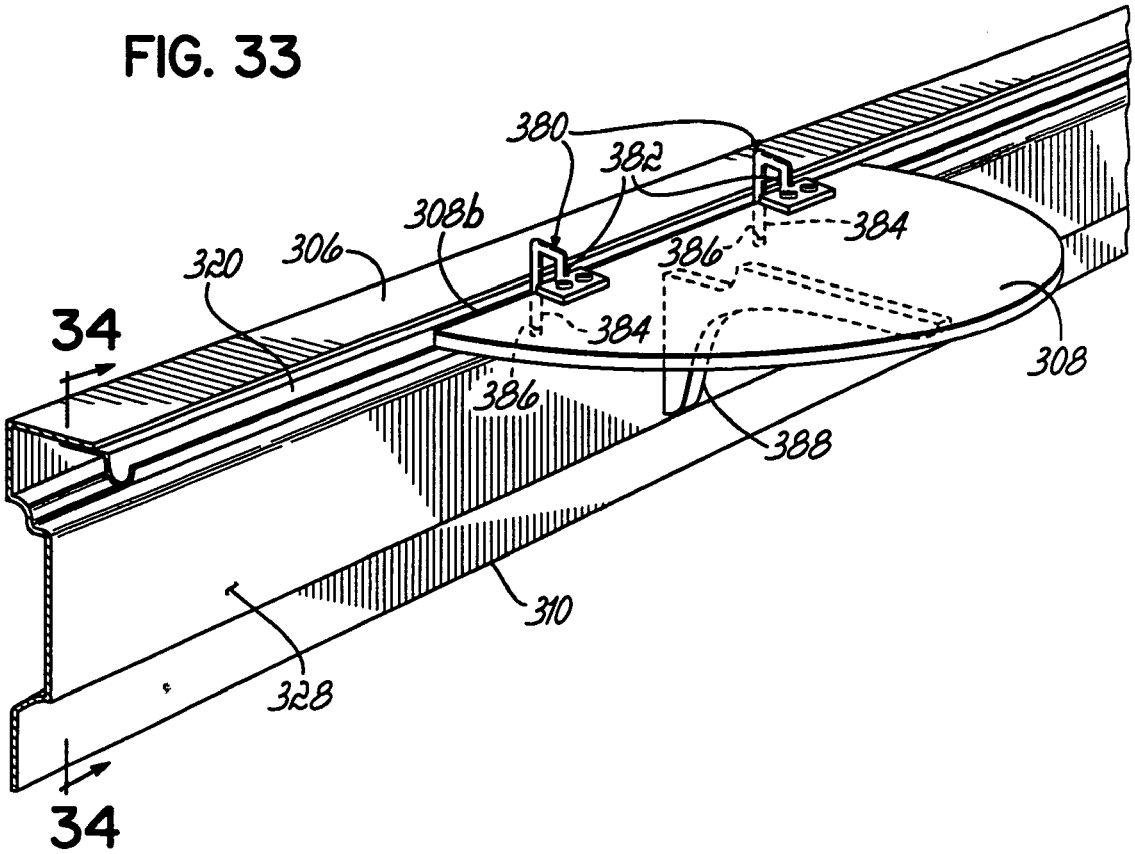
Figure 34:
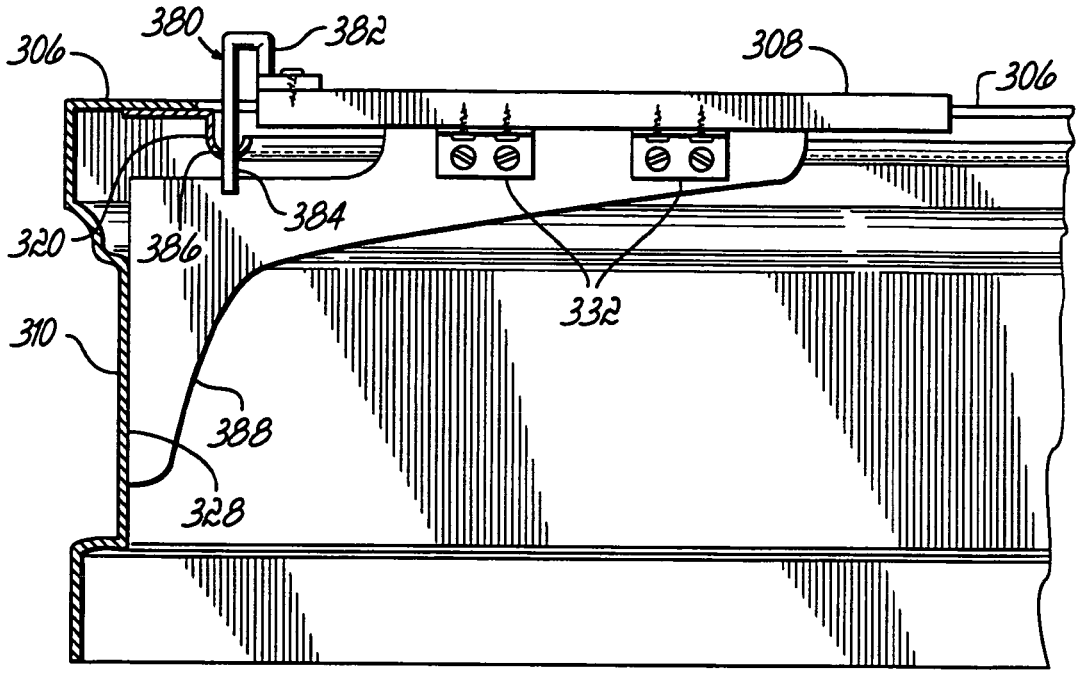

Referring now to FIGS. 33 and 34, one edge 314*b* of the shelf 314 can have at least two L-shaped rods 380 mounted thereto. Each rod 380 can have a leg 382 and a foot 384. The leg 382 can be mounted to the shelf 314, and the foot 384 can extend downward through a hole 386 in the upper edge 306 of the shell 302. The one edge 314*b* of the shelf 314 can have a brace 388 contacting an interior wall 328 of the shell 302 to thereby support the shelf 314. FIGS. 34 and 35 illustrate a similar arrangement for shelf 308.

Figure 36:
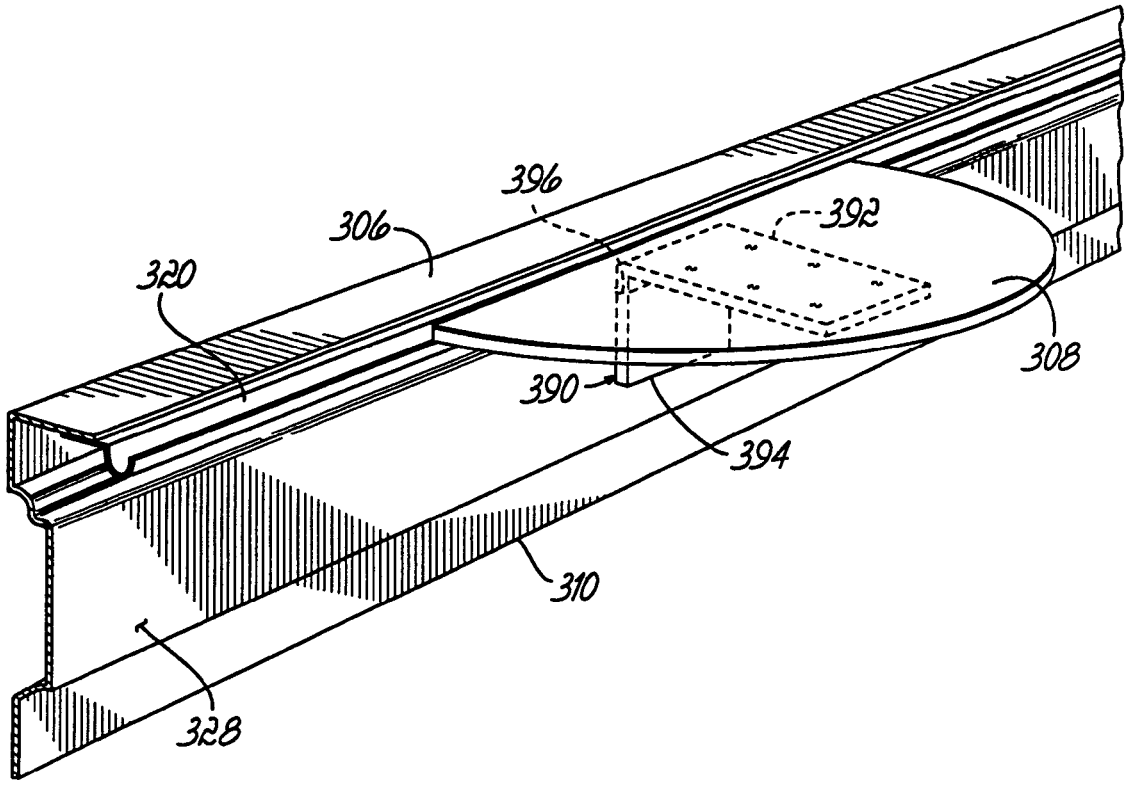

Referring now to FIG. 36, shelf 308 can have a brace 390 constructed of flat sheet stock material having a leg 392 and a foot 394. The leg 392 can be mounted to the shelf 308 and the foot 394 can extend downward through a slot 396 in the upturned lip 320 of the upper edge 306 of the shell 302.

Figure 37:
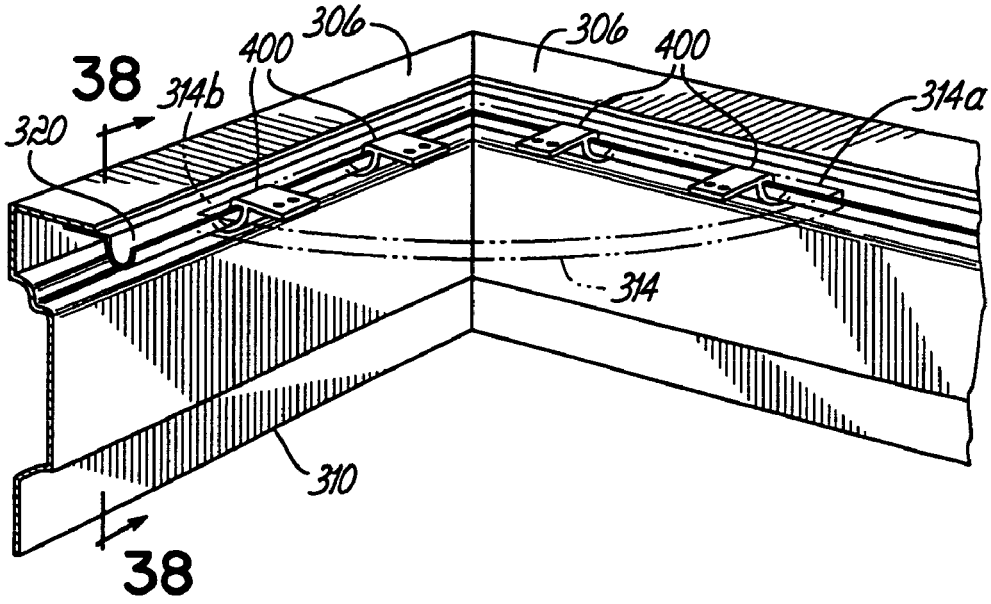
Figure 38:
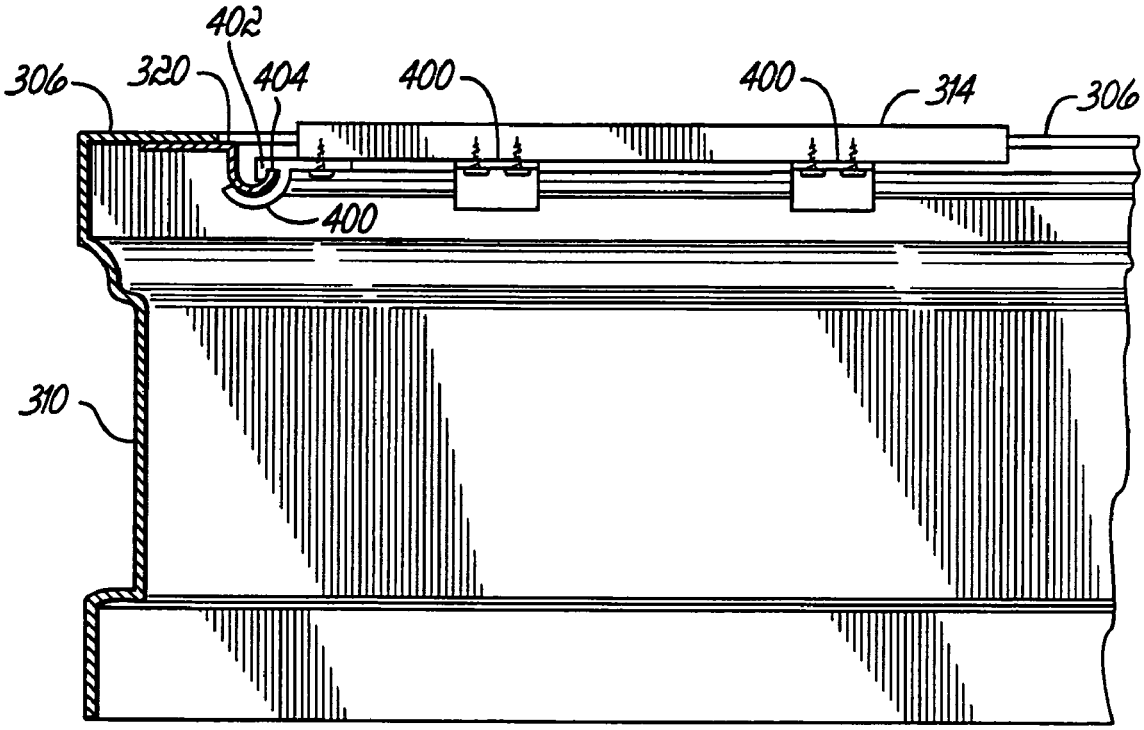

Referring now to FIGS. 37 and 38, one edge 314*a* of shelf 314 can have at least one upturned bracket 400 mounted thereto, and the other edge 314b can have at least one upturned bracket 400 mounted thereto. Each upturned bracket 400 can have a downturned lip 402 thereon. The brackets 400 can receive therein the upturned lip 320 of the upper edge 306 of the shell 302. The downturned lips 402 of the brackets 400 can be supported on an edge 404 of the upturned lip 320 of the upper edge 306 of the shell 302 to thereby provide moment load carrying capability for the brackets 400 and hence the shelf 314.

Figure 39:
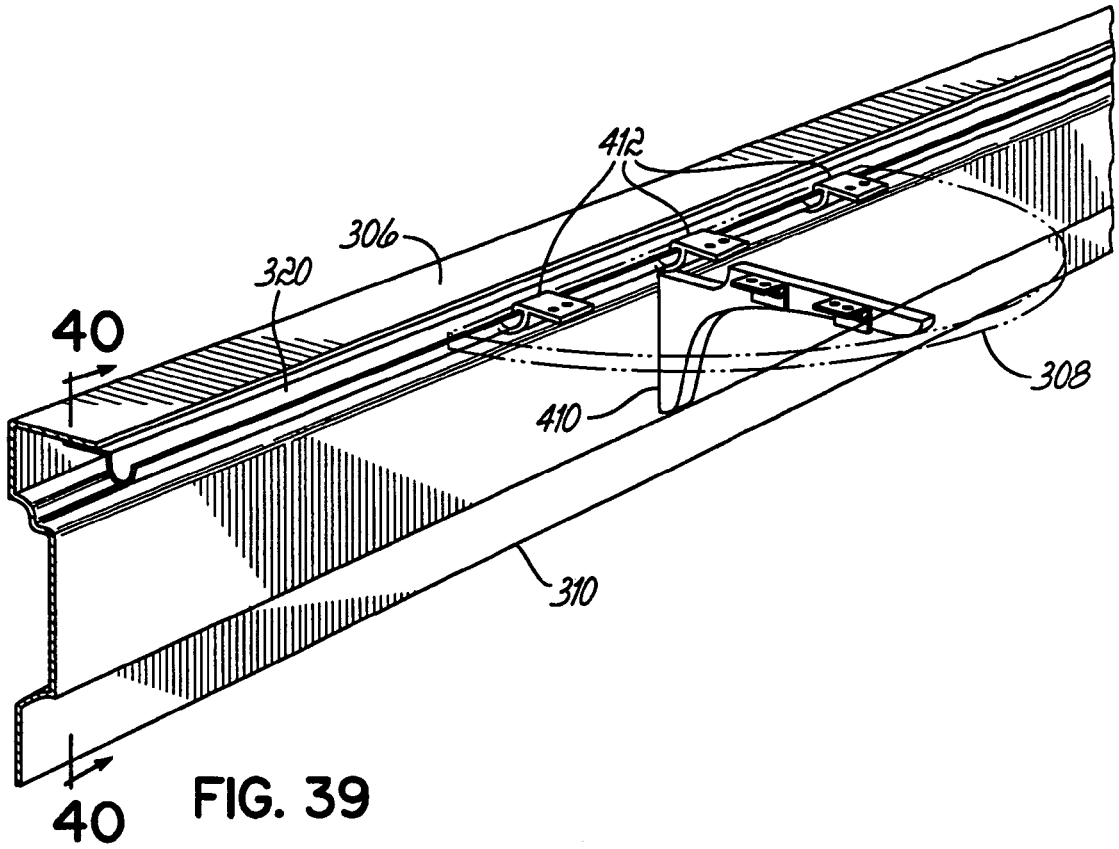
Figure 40:
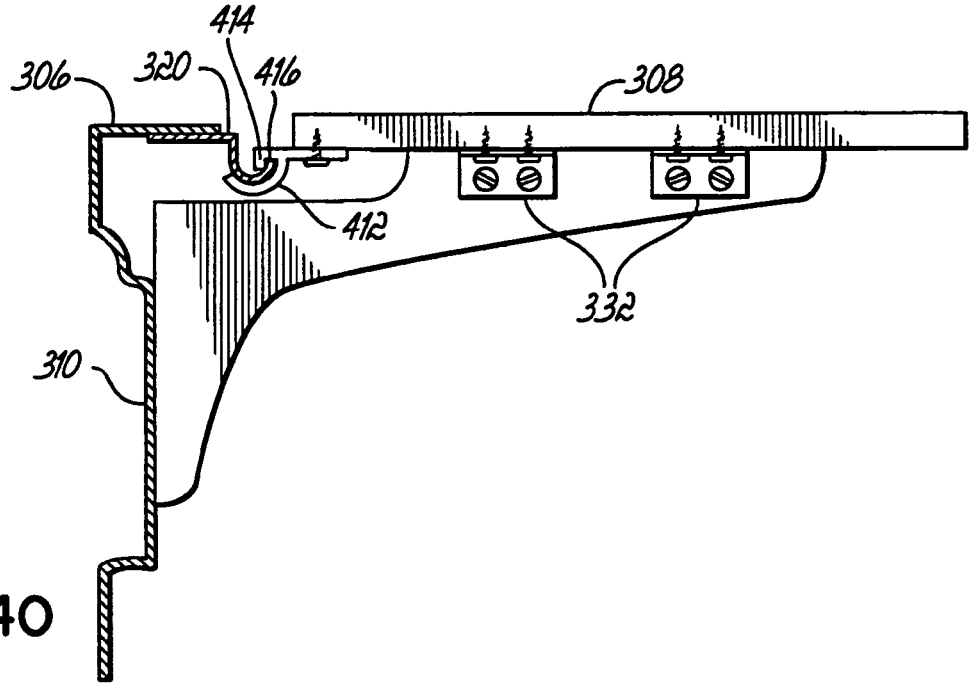

Referring now to FIGS. 39 and 40, shelf 308 can have a brace 410 and at least two upturned brackets 412. Each upturned bracket 412 can have a downturned lip 414 thereon. The brackets 412 can receive therein the upturned lip 320 of the upper edge 306 of the shell 302. The downturned lips 414 of the brackets 412 can be supported on an edge 416 of the upturned lip 320 on the upper edge 306 of the shell 302 to thereby provide moment load carrying capability for the brackets 412 and hence the shelf 308, the brace 410 contacting an interior wall 328 of the shell 302.

Figure 41:
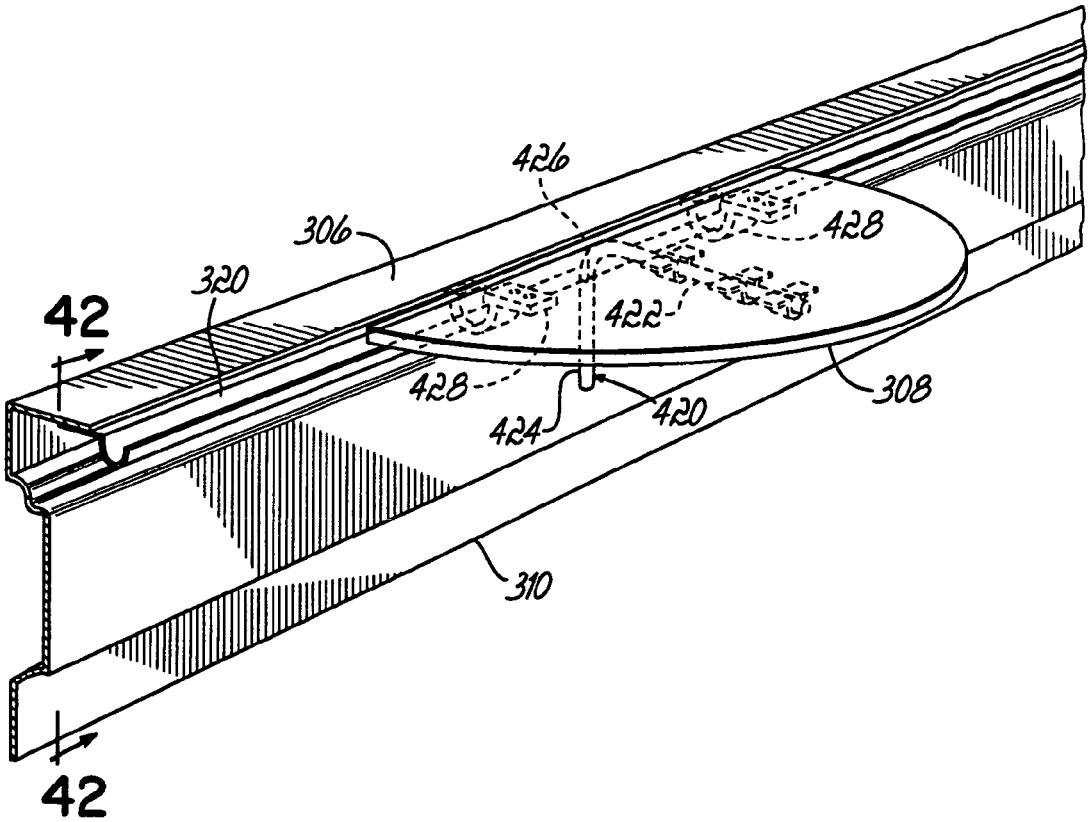
Figure 42:
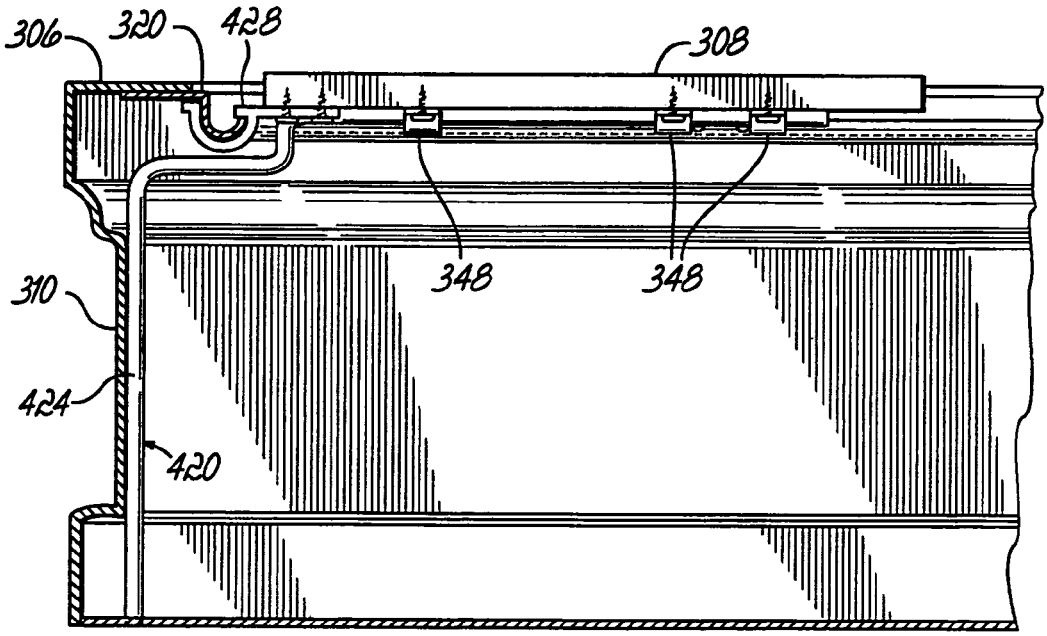

Referring now to FIG. 41, shelf 308 can have an L-shaped rod 420 mounted thereto having a leg 422 and a foot 424. The leg 422 can be mounted to the shelf 308. The foot 424 can extend downward through a hole 426 in the upturned lip 320 of the upper edge 306 of the shell 302, or underneath the upturned lip 320 and downwardly so as contact an interior wall and/or the bottom of the shell as shown in FIG. 42. The shelf can have at least two upturned brackets 428 mounted thereto. The brackets 428 can receive therein the upturned lip 320 of the upper edge 306 of the shell 302. The rod 420 can be circular in cross-section, and can be mounted to an underneath side of the shelf 308 with semi-circular brackets. In that way, the rod 420 can be folded to and between a shelf supporting position generally perpendicular to the shelf 308 and a storage position generally parallel and abutting the shelf 308.

Figure 43:
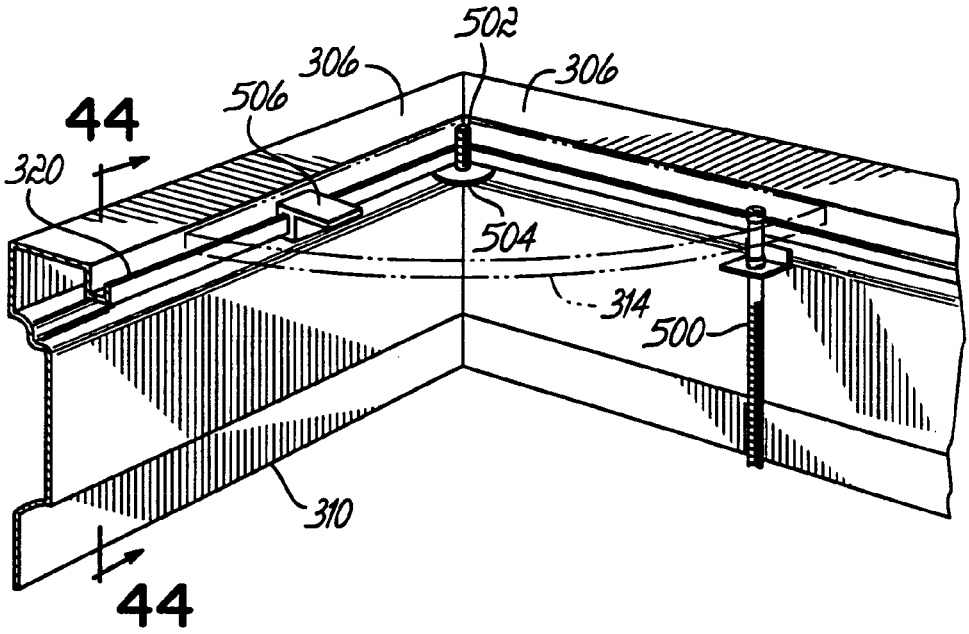
Figure 44:
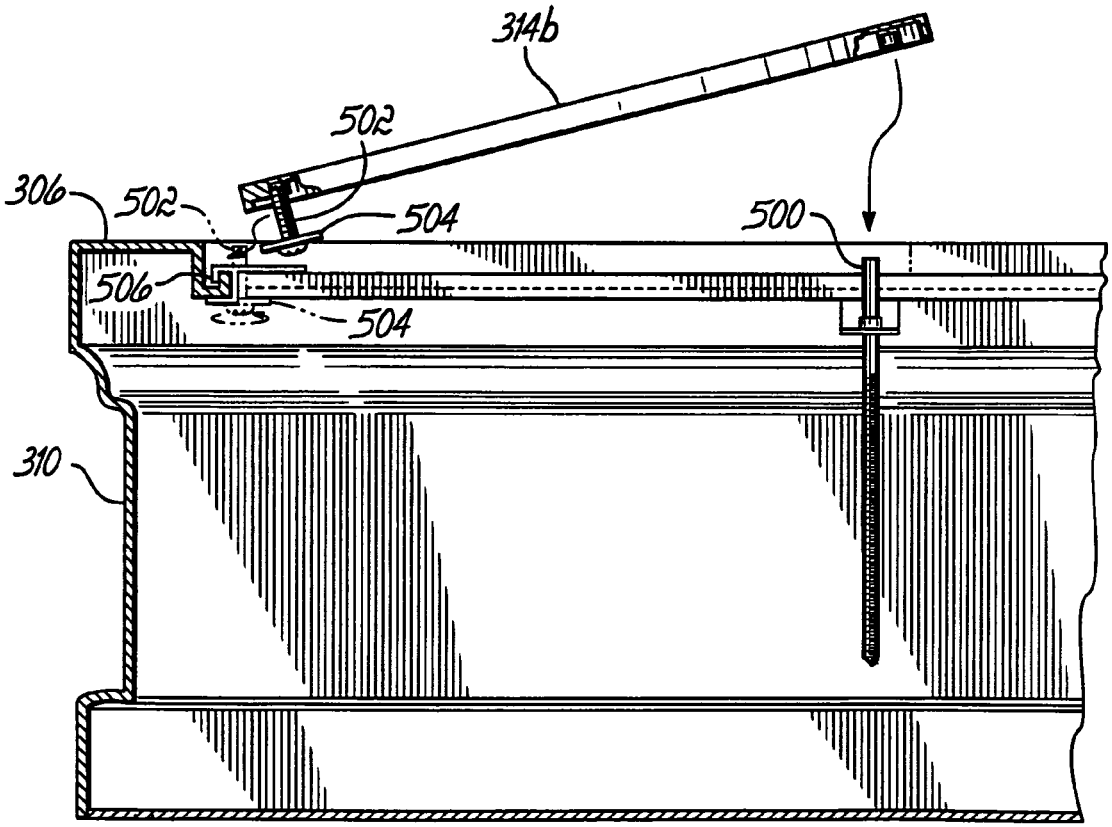

Referring now to FIGS. 43 and 44, shelf 314 can be supported at three points on shell 302. One support point can be the upper end of a screw 500 which is the actuation device for a lift mechanism or lift/tilt mechanism for the bed of the casket (not shown). A second support point can be at the comer of the side walls of the shell 302. A screw 502 can be secured to an underside of shelf 314. Screw 502 can carry a washer 504. Washer 504 can be positioned beneath upturned lip or flange 302. A third support point can be a shelf clip 506 which fits over and under flange 302.

Those skilled in the art will recognize that numerous adaptations and modifications can be made to the present invention which will result in an improved memorialization casket, yet all of which will fall within the spirit and scope of the present invention as defined in the following claims. For example, the memorialization shelf would not have to be pivoted to the lid to be within the scope of the invention. The shelf could be supported between the lid and the shell flange with or without braces, pins, etc. The shelf could be supported on a block, for example, polystyrene block, supported by the bed of the casket. The shelf could be supported on a bracket or brace attached to the carrying handle of the casket and extending over the body. The shelf could be supported on a bracket or brace extending from one side flange of the shell to the other side flange of the shell. Accordingly, the invention is to be limited only by the scope of the following claims and their equivalents.

What is claimed is:

1. A casket comprising:

a casket shell having an upper edge, said upper edge having an outer perimeter;

a casket lid closeable upon said shell; and a memorial shelf connected to said upper edge of said shell in such a manner that said shelf is positioned only and entirely within the outer perimeter of said upper edge, said shelf adapted to support items of memorialization thereon.

2. The casket of claim 1 wherein said shell has a pair of sides and a pair of ends.

3. The casket of claim 2 wherein said shelf is mounted to one of said sides of said shell.

4. The casket of claim 3 wherein said shelf is semi-circular shaped.

5. The casket of claim 2 wherein said shelf is mounted to one of said sides of said shell and to an adjacent one of said ends of said shell.

6. The casket of claim 5 wherein said shelf is pie-shaped.

7. The casket of claim 1 wherein said shelf includes a brace mounted thereto, said brace contacting an interior wall of said shell and supporting said shelf.

8. The casket of claim 1 wherein said shelf includes a pair of L-shaped rods mounted thereto, each of said pair having a leg and a foot, said leg mounted to said shelf, said foot extending downward into said upper edge of said shell.

9. A casket comprising:

a casket shell having an upper edge;

a casket lid closeable upon said shell; and a memorial shelf connected to said upper edge of said shell, said shelf adapted to support items of memorialization thereon, wherein said upper edge of said shell has an upturned lip thereon such that said shelf is connected thereto.

10. The casket of claim 9 wherein said shelf has a bracket mounted thereon having a downturned lip thereon, said downturned lip on said shelf bracket supported on said upturned lip of said shell edge.

11. The casket of claim 9 wherein said shelf has a bracket mounted thereon having a downturned lip thereon, said downturned lip on said shelf bracket supported on said upturned lip of said shell edge, said shelf includes a brace mounted thereto, said brace contacting an interior wall of said shell and supporting said shelf.

12. The casket of claim 9 wherein said shelf includes a pair of L-shaped rods mounted thereto, each of said pair having a leg and a foot, said leg mounted to said shelf, said foot extending downward through a hole in said upturned lip.

13. The casket of claim 9 wherein said shelf has a brace and at least two upturned brackets mounted thereto, said brace contacting an interior wall of said shell and said brackets receiving therein said upturned lip of said upper edge of said shell to thereby support said shelf.

14. The casket of claim 9 wherein one edge of said shelf has at least one L-shaped rod mounted thereto, said rod having a leg and a foot, said leg mounted to said shelf, said foot extending downward through a hole in said upper edge of said shell, the other edge of said shelf has at least one upturned bracket mounted thereto, said bracket receiving therein said upturned lip of said upper edge of said shell to thereby support said shelf.

15. The casket of claim 9 wherein said shelf has a brace constructed of flat stock having a leg and a foot, said leg mounted to said shelf, said foot extending downward through a slot in said upturned lip of said upper edge of said shell to thereby support said shelf.

16. The casket of claim 9 wherein one edge of said shelf has at least one upturned bracket mounted thereto, the other edge of said shelf has at least one upturned bracket mounted thereto, each upturned bracket has a downturned lip thereon, said brackets receiving therein said upturned lip of said upper edge of said shell, said downturned lips of said brackets supported on an edge of said upturned lip on said upper edge of said shell to thereby provide moment load carrying capability for said brackets and hence said shelf.

17. The casket of claim 9 wherein said shelf has a brace and at least two upturned brackets mounted thereto, each upturned bracket has a downturned lip thereon, said brackets receiving therein said upturned lip of said upper edge of said shell, said downturned lips of said brackets supported on an edge of said upturned lip on said upper edge of said shell to thereby provide moment load carrying capability for said brackets and hence said shelf, said brace contacting an interior wall of said shell.

18. The casket of claim 9 wherein said shelf has a L-shaped rod mounted thereto having a leg and a foot, said leg mounted to said shelf, said foot extending downward through a hole in said upturned lip of said upper edge of said shell, said shelf has at least two upturned brackets mounted thereto, said brackets receiving therein said upturned lip of said upper edge of said shell.

19. The casket of claim 18 wherein said rod is circular in cross-section and is mounted to an underneath side of said shelf with semi-circular brackets, whereby said rod can be folded to and between a shelf supporting position generally perpendicular to said shelf and a storage position generally parallel and abutting said shelf.

20. The casket of claim 9 wherein said shelf has a L-shaped rod mounted thereto having a leg and a foot, said leg mounted to said shelf, said foot extending downward and contacting an interior wall of said shell, said shelf has at least two upturned brackets mounted thereto, said brackets receiving therein said upturned lip of said upper edge of said shell.

21. A casket comprising:

a casket shell having an upper edge;

a casket lid closeable upon said shell; and a memorial shelf connected to said upper edge of said shell, said shelf adapted to support items of memorialization thereon, wherein said shelf includes a brace mounted thereto, said brace contacting an interior wall of said shell and supporting said shelf, wherein said brace is attached to an underneath side of said shelf by at least one hinge, whereby said brace is folded to and between a shelf supporting position generally perpendicular to said shelf and a storage position generally parallel and abutting said shelf.

22. A casket comprising:

a casket shell having an upper edge;

a casket lid closeable upon said shell; and a memorial shelf connected to said upper edge of said shell, said shelf adapted to support items of memorialization thereon, wherein said shelf includes a pair of L-shaped rods mounted thereto, each of said pair having a leg and a foot, said leg mounted to said shelf, said foot extending downward into said upper edge of said shell, wherein said rods are circular in cross-section and are mounted to an underneath side of said shelf with semi-circular brackets, whereby said rods can be folded to and between a shelf supporting position generally perpendicular to said shelf and a storage position generally parallel and abutting said shelf.

23. A casket comprising:

a casket shell having an upper edge;

a casket lid closeable upon said shell; and a memorial shelf connected to said upper edge of said shell, said shelf adapted to support items of memorialization thereon, wherein said upper edge of said shell is formed to include first and second interior surfaces and said shelf has a pair of braces mounted thereon each having first and second surfaces which cooperate with said first and second interior surfaces of said upper edge of said shell to thereby provide moment load carrying capability for said brace and hence said shelf.

24. A casket comprising:

a casket shell having an upper edge;

a casket lid closeable upon said shell; and a memorial shelf connected to said upper edge of said shell, said shelf adapted to support items of memorialization thereon, wherein one edge of said shelf has at least two L-shaped rods mounted thereto, said rods each having a leg and a foot, said leg mounted to said shelf, said foot extending downward through a hole in said upper edge of said shell, said one edge of said shelf has a brace contacting an interior wall of said shell to thereby support said shelf.

25. A full couch casket comprising:

a casket shell having an upper edge and an interior therein, said upper edge having an outer perimeter;

a single casket lid closeable upon said shell and covering an entirety of said interior of said shell; and a memorial shelf connected to said upper edge of said shell and projecting toward said interior of said shell, said shelf connected to said upper edge of said shell in such a manner that said shelf is positioned only and entirely within the outer perimeter of said upper edge, said shelf adapted to support items of memorialization thereon.

26. The casket of claim 25 wherein said shell has a pair of sides and a pair of ends.

27. The casket of claim 26 wherein said shelf is mounted to one of said sides of said shell.

28. The casket of claim 25 wherein said shelf includes a brace mounted thereto, said brace contacting an interior wall of said shell and supporting said shelf.

29. The casket of claim 25 wherein said shelf includes a pair of L-shaped rods mounted thereto, each of said pair having a leg and a foot, said leg mounted to said shelf, said foot extending downward into said upper edge of said shell.

30. A full couch casket comprising:

a casket shell having an upper edge and an interior therein, said upper edge having an outer perimeter;

a single casket lid closeable upon said shell and covering an entirety of said interior of said shell; and a memorial shelf connected to said upper edge of said shell in such a manner that said shelf is positioned only and entirely within the outer perimeter of said upper edge of said shell and projects toward said interior of said shell, said shelf adapted to support items of memorialization thereon, wherein said shell has a pair of sides and a pair of ends, wherein said shelf is mounted to one of said sides of said shell, wherein said shelf is semi-circular shaped.

31. A full couch casket comprising:

a casket shell having an upper edge and an interior therein;

a single casket lid closeable upon said shell and covering an entirety of said interior of said shell; and a memorial shelf connected to said upper edge of said shell and projecting toward said interior of said shell, said shelf adapted to support items of memorialization thereon, wherein said shell has a pair of sides and a pair of ends, wherein said shelf is mounted to one of said sides of said shell and to an adjacent one of said ends of said shell, wherein said shelf is pie-shaped.

32. A full couch casket comprising:

a casket shell having an upper edge and an interior therein;

a single casket lid closeable upon said shell and covering an entirety of said interior of said shell; and a memorial shelf connected to said upper edge of said shell and projecting toward said interior of said shell, said shelf adapted to support items of memorialization thereon, wherein said upper edge of said shell has an upturned lip thereon such that said shelf is connected thereto.

33. The casket of claim 32 wherein said shelf has a bracket mounted thereon having a downturned lip thereon, said shelf bracket supported on said upturned lip of said shell edge.

34. The casket of claim 32 wherein said shelf has a bracket mounted thereon having a downturned lip thereon, said downturned lip on said shelf bracket supported on said upturned lip of said shell edge, said shelf includes a brace mounted thereto, said brace contacting an interior wall of said shell and supporting said shelf.

35. The casket of claim 32 wherein said shelf includes a pair of L-shaped rods mounted thereto, each of said pair having a leg and a foot, said leg mounted to said shelf, said foot extending downward through a hole in said upturned lip.

36. The casket of claim 35 wherein said rods are circular in cross-section and are mounted to an underneath side of said shelf with semi-circular brackets, whereby said rods can be folded to and between a shelf supporting position generally perpendicular to said shelf and a storage position generally parallel and abutting said shelf.

37. The casket of claim 32 wherein said shelf has a brace and at least two upturned brackets mounted thereto, said brace contacting an interior wall of said shell and said brackets receiving therein said upturned lip of said upper edge of said shell to thereby support said shelf.

38. The casket of claim 32 wherein one edge of said shelf has at least one L-shaped rod mounted thereto, said rod having a leg and a foot, said leg mounted to said shelf, said foot extending downward through a hole in said upper edge of said shell, the other edge of said shelf has at least one upturned bracket mounted thereto, said bracket receiving therein said upturned lip of said upper edge of said shell to thereby support said shelf.

39. The casket of claim 32 wherein said shelf has a brace constructed of flat stock having a leg and a foot, said leg mounted to said shelf, said foot extending downward through a slot in said upturned lip of said upper edge of said shell to thereby support said shelf.

40. The casket of claim 32 wherein one edge of said shelf has at least one upturned bracket mounted thereto, the other edge of said shelf has at least one upturned bracket mounted thereto, each upturned bracket has a downturned lip thereon, said brackets receiving therein said upturned lip of said upper edge of said shell, said downturned lips of said brackets supported on an edge of said upturned lip on said upper edge of said shell to thereby provide moment load carrying capability for said brackets and hence said shelf.

41. The casket of claim 32 wherein said shelf has a brace and at least two upturned brackets mounted thereto, each upturned bracket has a downturned lip thereon, said brackets receiving therein said upturned lip of said upper edge of said shell, said downturned lips of said brackets supported on an edge of said upturned lip on said upper edge of said shell to thereby provide moment load carrying capability for said brackets and hence said shelf, said brace contacting an interior wall of said shell.

42. The casket of claim 32 wherein said shelf has a L-shaped rod mounted thereto having a leg and a foot, said leg mounted to said shelf, said foot extending downward through a hole in said upturned lip of said upper edge of said shell, said shelf has at least two upturned brackets mounted thereto, said brackets receiving therein said upturned lip of said upper edge of said shell.

43. The casket of claim 42 wherein said rod is circular in cross-section and is mounted to an underneath side of said shelf with semi-circular brackets, whereby said rod can be folded to and between a shelf supporting position generally perpendicular to said shelf and a storage position generally parallel and abutting said shelf.

44. The casket of claim 32 wherein said shelf has a L-shaped rod mounted thereto having a leg and a foot, said leg mounted to said shelf, said foot extending downward and contacting an interior wall of said shell, said shelf has at least two upturned brackets mounted thereto, said brackets receiving therein said upturned lip of said upper edge of said shell.

45. A full couch casket comprising:

a casket shell having an upper edge and an interior therein;

a single casket lid closeable upon said shell and covering an entirety of said interior of said shell; and a memorial shelf connected to said upper edge of said shell and projecting toward said interior of said shell, said shelf adapted to support items of memorialization thereon, wherein said shelf includes a brace mounted thereto, said brace contacting an interior wall of said shell and supporting said shelf, wherein said brace is attached to an underneath side of said shelf by at least one hinge, whereby said brace is folded to and between a shelf supporting position generally perpendicular to said shelf and a storage position generally parallel and abutting said shelf.

46. A full couch casket comprising:

a casket shell having an upper edge and an interior therein;

a single casket lid closeable upon said shell and covering an entirety of said interior of said shell; and a memorial shelf connected to said upper edge of said shell and projecting toward said interior of said shell, said shelf adapted to support items of memorialization thereon, wherein said upper edge of said shell is formed to include first and second interior surfaces and said shelf has a pair of braces mounted thereon each having first and second surfaces which cooperate with said first and second interior surfaces of said upper edge of said shell to thereby provide moment load carrying capability for said brace and hence said shelf.

47. A full couch casket comprising:

a casket shell having an upper edge and an interior therein;

a single casket lid closeable upon said shell and covering an entirety of said interior of said shell; and a memorial shelf connected to said upper edge of said shell and projecting toward said interior of said shell, said shelf adapted to support items of memorialization thereon, wherein one edge of said shelf has at least two L-shaped rods mounted thereto, said rods each having a leg and a foot, said leg mounted to said shelf, said foot extending downward through a hole in said upper edge of said shell, said one edge of said shelf has a brace contacting an interior wall of said shell to thereby support said shelf.

48. A full couch casket comprising:

a casket shell having an upper edge and an interior therein;

a single casket lid closeable upon said shell and covering an entirety of said interior of said shell; and a memorial shelf connected to said upper edge of said shell and projecting toward said interior of said shell, said shelf adapted to support items of memorialization thereon;

said shelf supported on an upper end of a screw of a lift mechanism, said shelf having a screw secured to an underside thereof, said screw carrying a washer, said washer positioned beneath a flange of said shell, said shelf supported on a clip secured to said flange of said shell.

* * * * *

UNITED STATES PATENT AND TRADEMARK OFFICE

CERTIFICATE OF CORRECTION

PATENT NO. : 7,661,179 B2
APPLICATION NO. : 11/350986
DATED : February 16, 2010
INVENTOR(S) : Parker et al.

It is certified that error appears in the above-identified patent and that said Letters Patent is hereby corrected as shown below:

Column 8, line 60 reads: "comer of the side walls of the shell 302. A screw 502 can be"; it should read: -- corner of the side walls of the shell 302. A screw 502 can be --.

Column 12, lines 36-37 read: "mounted thereon having a downturned lip thereon, said shelf bracket supported on said upturned lip of said shell edge."; they should read: -- mounted thereon having a downturned lip thereon, said downturned lip on said shelf bracket supported on said upturned lip of said shell edge. --.

Signed and Sealed this

Twenty-first Day of September, 2010

David J. Kappos

David J. Kappos
*Director of the United States Patent and Trademark Office*